United States Patent [19]

Naito et al.

[11] 4,422,816

[45] Dec. 27, 1983

[54] SHIFTABLE ARTICLE STORAGE DEVICE

[75] Inventors: Han-Ichiro Naito, Akishima; Tsuneo Yamaguchi, Tokyo; Kiyoshi Harashima, Ome, all of Japan

[73] Assignee: Elecompack Company Ltd., Tokyo, Japan

[21] Appl. No.: 124,726

[22] Filed: Mar. 16, 1971

[30] Foreign Application Priority Data

| | | | |
|---|---|---|---|
| Mar. 17, 1970 | [JP] | Japan | 45-22501 |
| Jun. 14, 1970 | [JP] | Japan | 45-61662 |
| Jun. 29, 1970 | [JP] | Japan | 45-56748 |
| Dec. 28, 1970 | [JP] | Japan | 45-125408 |

[51] Int. Cl.[3] ..... A47B 53/00

[52] U.S. Cl. ..... 414/331; 312/198; 312/201

[58] Field of Search ..... 214/16 B, 16.1 CC; 312/198–201; 414/331

[56] References Cited

U.S. PATENT DOCUMENTS

| | | | |
|---|---|---|---|
| 2,605,911 | 8/1952 | Medway | 214/16.1 CC |
| 3,055,313 | 9/1962 | Stoll et al. | 214/16 B |
| 3,206,041 | 9/1965 | McGrath | 214/16 B |
| 3,520,424 | 7/1970 | Lemelson | 214/16.4 A |
| 3,957,322 | 5/1976 | Mastronardi et al. | 312/198 |
| 3,957,323 | 5/1976 | Tucker et al. | 312/198 |
| 4,017,131 | 4/1977 | Camenisch | 312/201 |

FOREIGN PATENT DOCUMENTS

| | | | |
|---|---|---|---|
| 262746 | 11/1965 | Australia | 312/201 |
| 717832 | 9/1965 | Canada | 214/16.1 CC |
| 1922859 | 11/1969 | Fed. Rep. of Germany | 211/1.5 |

*Primary Examiner*—Trygve M. Blix
*Assistant Examiner*—Stephen P. Avila
*Attorney, Agent, or Firm*—Richard L. Cannaday; William J. Ungvarsky; Francis C. Hand

[57] ABSTRACT

A shiftable article storage device having a plurality of shiftable article storage units each adapted for mounting articles to be stored thereon and provided with a driving source, the article storage units being put together with no interval between each other when not in use but shifted, when an article on one of them is desired to be taken out, in such a manner that an aisle is formed on one side of the one article storage unit to provide access to the article.

7 Claims, 40 Drawing Figures

24
24
13
13
13
23
23
23
14
14
12
2
9A
11A
9B
9C
9D
9E
9F
1
A
3
B
4
C
5
D
6
E
7
F
10A
10B
10C
10D
10E
10F
11B
11C
11D
11E
11F

SHIFTABLE ARTICLE STORAGE DEVICE

This invention relates to shiftable article storage devices comprising a plurality of shiftable article storage units for mounting articles to be stored thereon, said article storage units being put together with no interval between each other when not in use but shifted, when an article on one of them is desired to be taken out, in such a manner that an aisle is formed on one side of said article storage unit to provide access to said article.

In order that a large number of article storage units may be accommodated in a narrow space, there has been proposed a shiftable article storage device having a plurality of shiftable article storage units closely arranged over the entire area of a given space except for an area just enough to form an aisle, said shiftable article storage units being shifted when access is desired to be had to one of them, in such a manner that an aisle is formed between said particular article storage unit and the adjacent unit.

In the conventional shiftable article storage device of the type described, only one motor is provided as a driving source and the shiftable article storage units are shifted by power transmitting members, such as chains or feeders, driven by said motor. Therefore, the load imposed on the motor varies according to the number of the article storage units to be shifted, which requires the output of the motor to be large. In addition, when the articles stored on the shiftable article storage units are large in size and/or heavy in weight, the shifting of a plurality of the article storage units by a single motor results in overloading of the motor and calls for a large-sized and complicated driving mechanism since the strengths of the power transmitting members must be increased.

Further, in most of the conventional shiftable article storage devices, only a space just enough to form an aisle is usually available for the entire device as stated above or for each of a plurality of groups into which the article storage units of the device are segregated. Therefore, when the location of the aisle is desired to be shifted from one place to another, it is necessary to return the device to the original state upon completion of the work through the aisle formed at said one place and then operate the device to form an aisle at said another location, and such cumbersome operation must be performed at each occurrence of storage work. This has been the most serious shortcoming of the conventional devices.

The present invention relates to improvements in the shiftable article storage devices of the type described. Namely, an object of the present invention is to provide a shiftable article storage device wherein each of a plurality of article storage units is provided with a driving motor, whereby the article storage units can be individually shifted without being influenced by the size and weight of the articles stored thereon, and the storage work can be achieved by a simple operation with high efficiency.

Another object of the invention is to provide a shiftable article storage device wherein a space sufficient to form a plurality of aisles is previously provided, whereby a plurality of aisles can be formed simultaneously at different locations between the article storage units.

Still another object of the invention is to provide a shiftable article storage device which is so designed that, once an aisle instruction is given, an aisle is formed at a designated location and the article storage units on both sides of the aisle are automatically locked and held immovable, even if the formation of the aisle at the other location is instructed, unless a return operation is performed.

Still another object of the invention is to provide a shiftable article storage device which is so designed that one or a plurality of optional article storage units are temporarily locked by operating a switch, whereby the entire article storage units are segregated into a plurality of groups, and an aisle can be formed within each of said groups independently of the other groups.

A further object of the invention is to provide a shiftable article storage device wherein each adjacent article storage units are shiftably connected with each other by aisle width control means by which the width of the aisle to be formed between the adjacent units upon shifting of the same is automatically controlled.

Other objects, features and advantages of the invention will become apparent from the following detailed description taken in conjunction with the accompanying drawings, in which.

Figure 1:
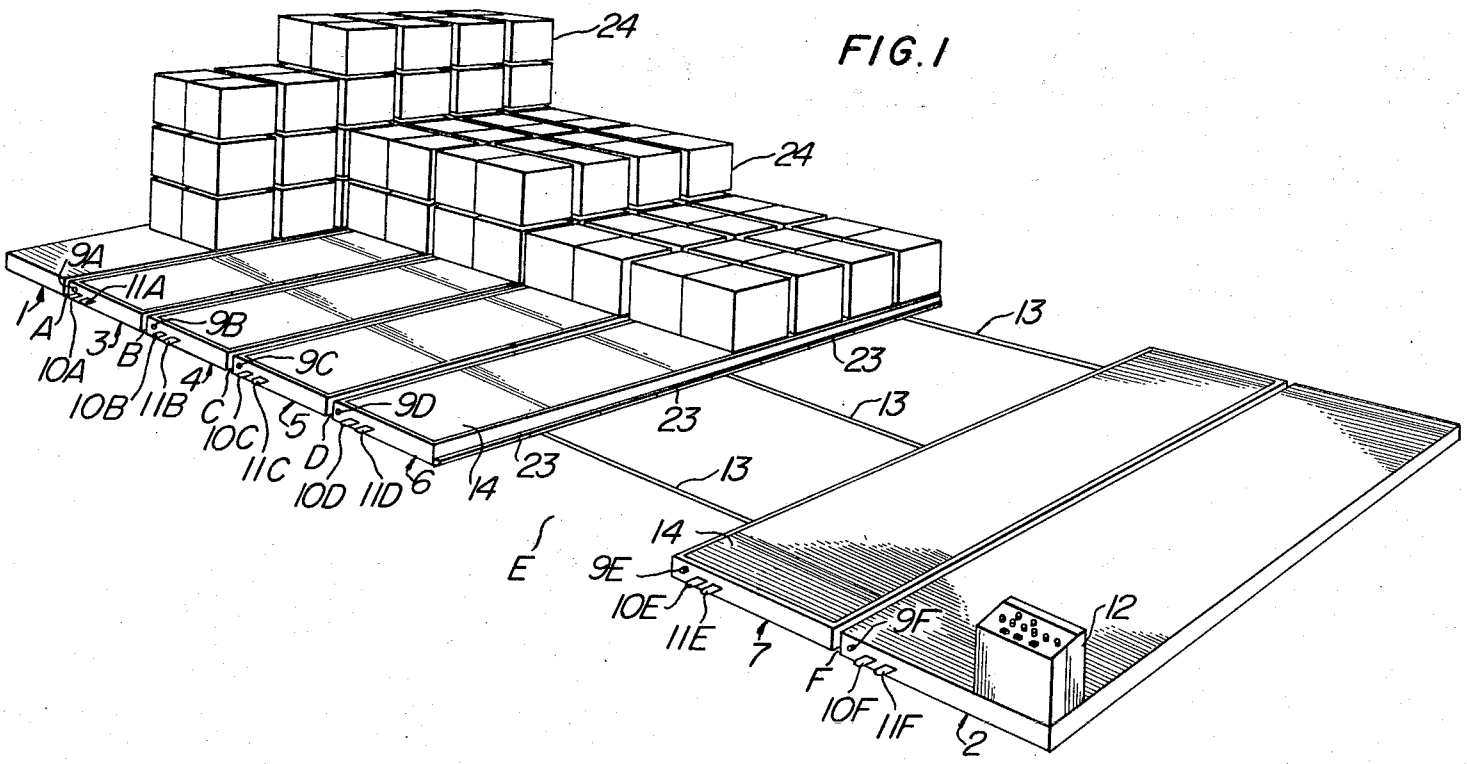
FIG. 1 is a perspective view of an embodiment of the present invention in which flat deck-type shiftable floor units are used as article storage units.

FIGS. 1 to 17 show an embodiment of the present invention in which article storage units are flat deck-type shiftable floor units. As shown in FIG. 1, the shiftable article storage device includes two stationary floor units 1 and 2 and five shiftable floor units 3, 4, 5, 6, and 7 interposed therebetween. Reference characters A, B, C, D, E and F designate aisles to be formed between the adjacent shiftable floor units, i.e., the aisle A is to be formed between the stationary floor unit 1 and the shiftable floor unit 3, and the aisle B is to be formed between the shiftable floor units 3 and 4, and so on. In the state of FIG. 1, the aisle E is formed. On the front faces of trucks 8 of the shiftable floor units 3 . . . 7 and the stationary floor unit 2 are respectively provided aisle indicating lamps 9A . . . 9F, aisle forming operating pedals 10A . . . 10F and restoring pedals 11A . . . 11F. The stationary floor unit 2 is provided with an operation control device 12 by which the shiftable article storage device is operated. The shiftable floor units 3 . . . 7 travel on guide rails 13 extending in the floor of a warehouse or the like in which the shiftable article storage device is provided.

Figure 2:
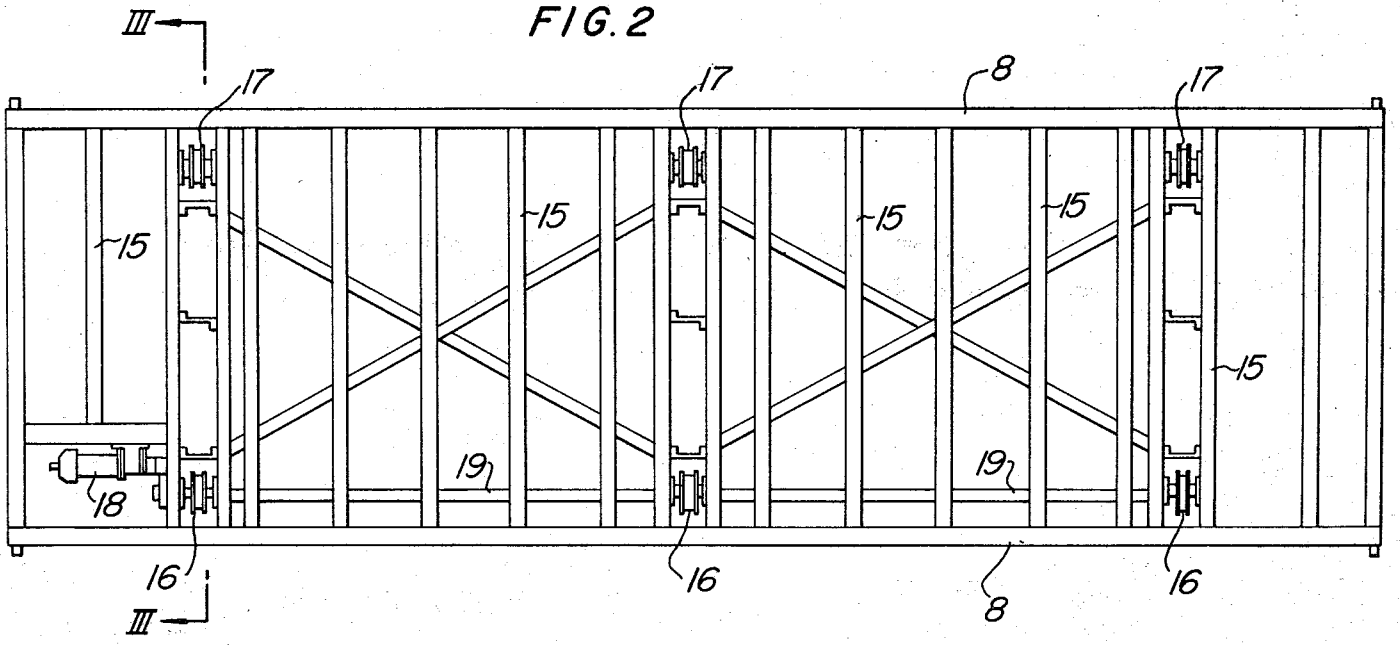
FIG. 2 is a plan view showing the shiftable floor unit with the floor boards removed.

As shown in FIG. 2, each of the shiftable floor units 3 . . . 7 is reinforced by a plurality of transverse girders 15 extending across the truck 8, and has driving wheels 16 and follower wheels 17 rotatably mounted thereon for rolling on the guide rails 13. The driving wheels 16 are mounted on a driving shaft 19 which is driven from a motor 18 mounted on the truck 8. The stationary floor units 1, 2 are obviously not provided with the driving wheels 17, the follower wheels 17 and the motor 18. The truck 8 may have a floor panel 14 attached to the upper surface thereof as shown in FIG. 1. or may be used in the state of FIG. 2, without having such a floor panel attached thereto.

Figure 3:
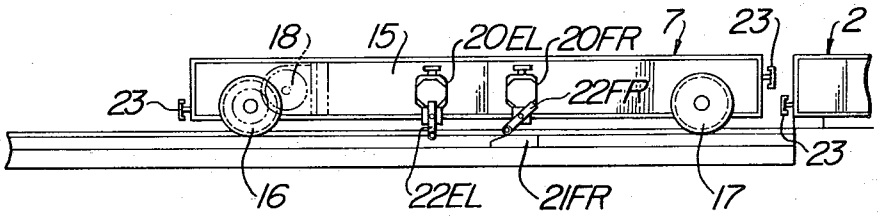
FIG. 3 is a view showing the shiftable floor unit in cross-section taken along the line III—III of FIG. 2 and a guide rail.

As shown in FIG. 3 by taking the shiftable floor unit 7 as an example, the transverse girders 15 supporting the driving wheels 16 and the follower wheels 17 are each provided with two limit switches 20EL and 20 FR respectively having switching bars 22EL and 22 FR. These limit switches 20 EL and 20FR are switched-on and off by the engagement between the switching bars 22EL and 22FR and projections 21EL and 21FR provided on both sides of the guide rails 13 respectively. Namely, the limit switch 20EL is switched off by the engagement of its switching bar 22EL with the projection 21FR when the shiftable floor unit 7 moves to the left as viewed in FIG. 1, whereas when the shiftable floor unit 7 moves to the right, the limit switch 20FR is switched off by the engagement of its switching bar 22FR with the projection 21FR, whereby the motor 18 is stopped.

Figure 5:
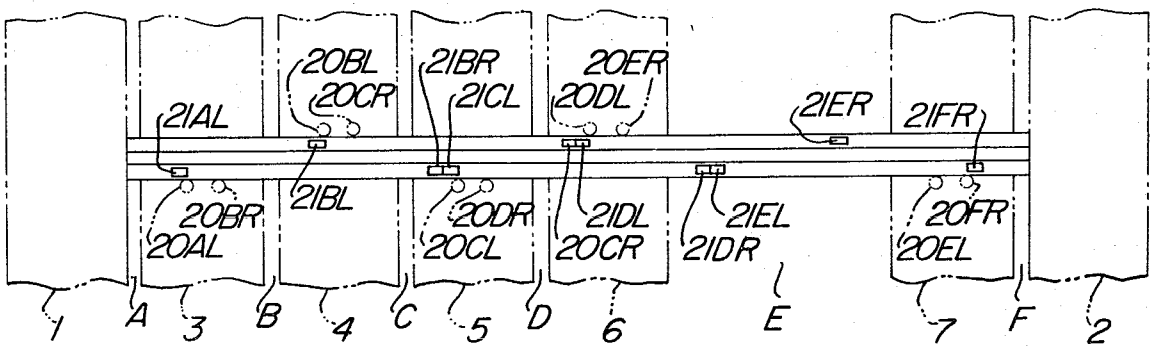
FIG. 5 is a view showing the arrangement of the operating projections on the sides of the guide rail.

These limit switches and the projections on both sides of the guide rail 13 are arranged zigzag with respect to said guide rail as shown in FIG. 5. The characters A–F suffixed to the reference numerals of the respective switches and projections represent the aisle A–F and the characters R and L represent directions, i.e. right and left, respectively.

Reference numeral 23 in FIG. 3 designates a safety bar provided on the face, perpendicular to the guide rail 13, of each truck 8. A safety bar operation signal receiving relay to be described later is actuated when the safety bar 23 is pushed.

Figure 6:
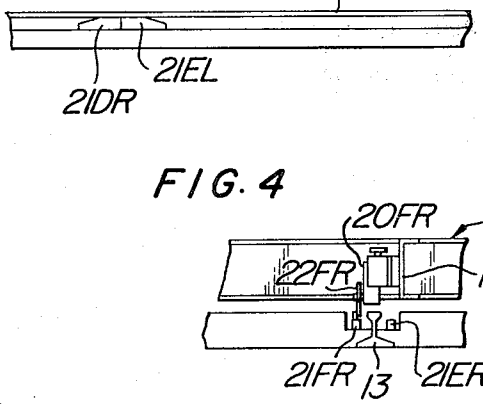
FIG. 6 is a view showing the arrangement of operating buttons on a control panel.
Figure 6:
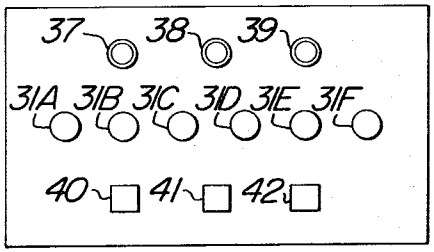
Figure 4:
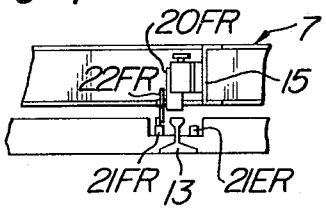
FIG. 4 is a view showing the relative position of the limit switch and the operating projections on the sides of the guide rail.

Referring to FIG. 6 there is shown the arrangement of operating buttons and indicator lamps provided on the operation control device 12 on the stationary floor unit 2. Namely, on the operation control device 12 are provided aisle buttons 31A . . . 31F for the formation of the respective aisles, a thermal operation indicating lamp 37 to indicate the thermal operation of the motor 18 on each shiftable floor unit, a safety device operation indicating lamp 38 to indicate the operation of the safety bar 23, a power source lamp 39, a special operation push button 40 for shifting the shiftable floor means even during actuation of the safety bar 23, a restoring push button 41 and an interlocking releasing button 42 for the formation of two or more aisles.

FIGS. 7 to 17 show a circuit to electrically drive the shiftable article storage device described above.

Figure 7:
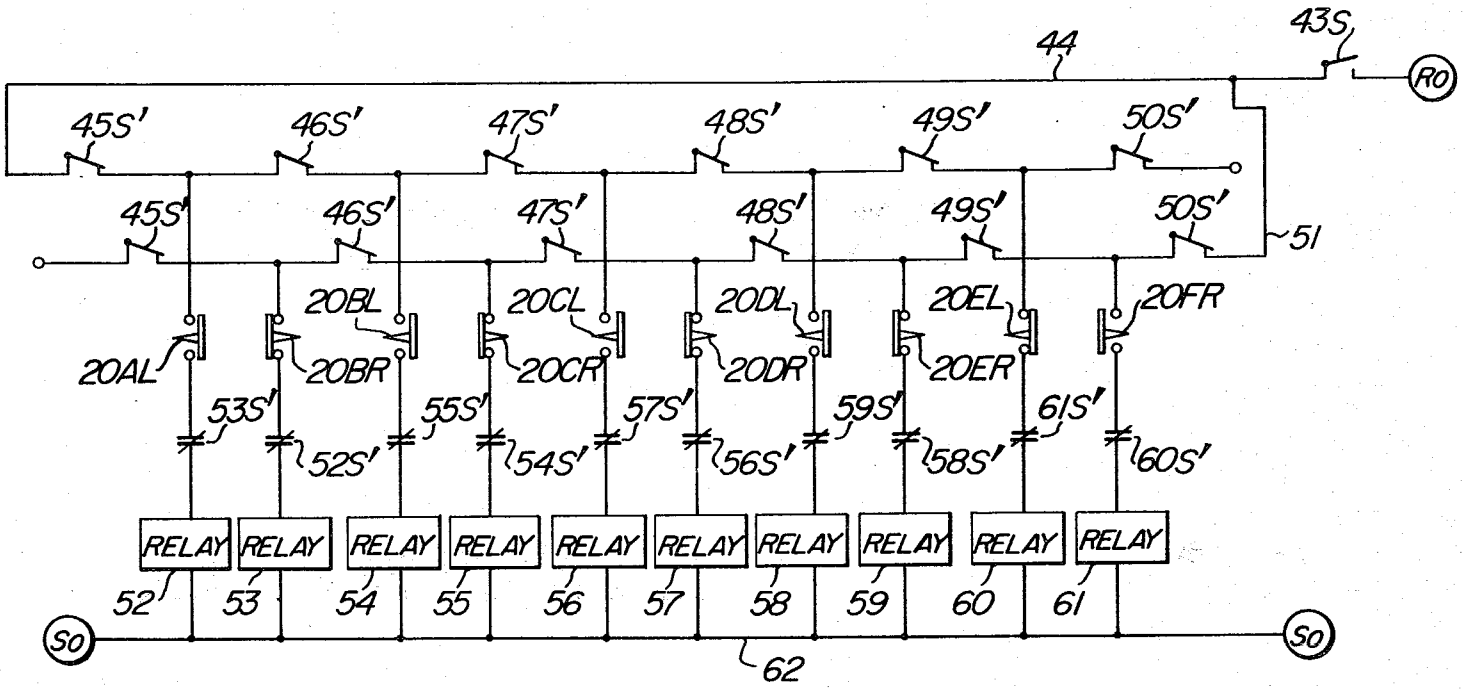
FIG. 7 is a circuit diagram of a shiftable floor unit selecting circuit.
Figure 13:
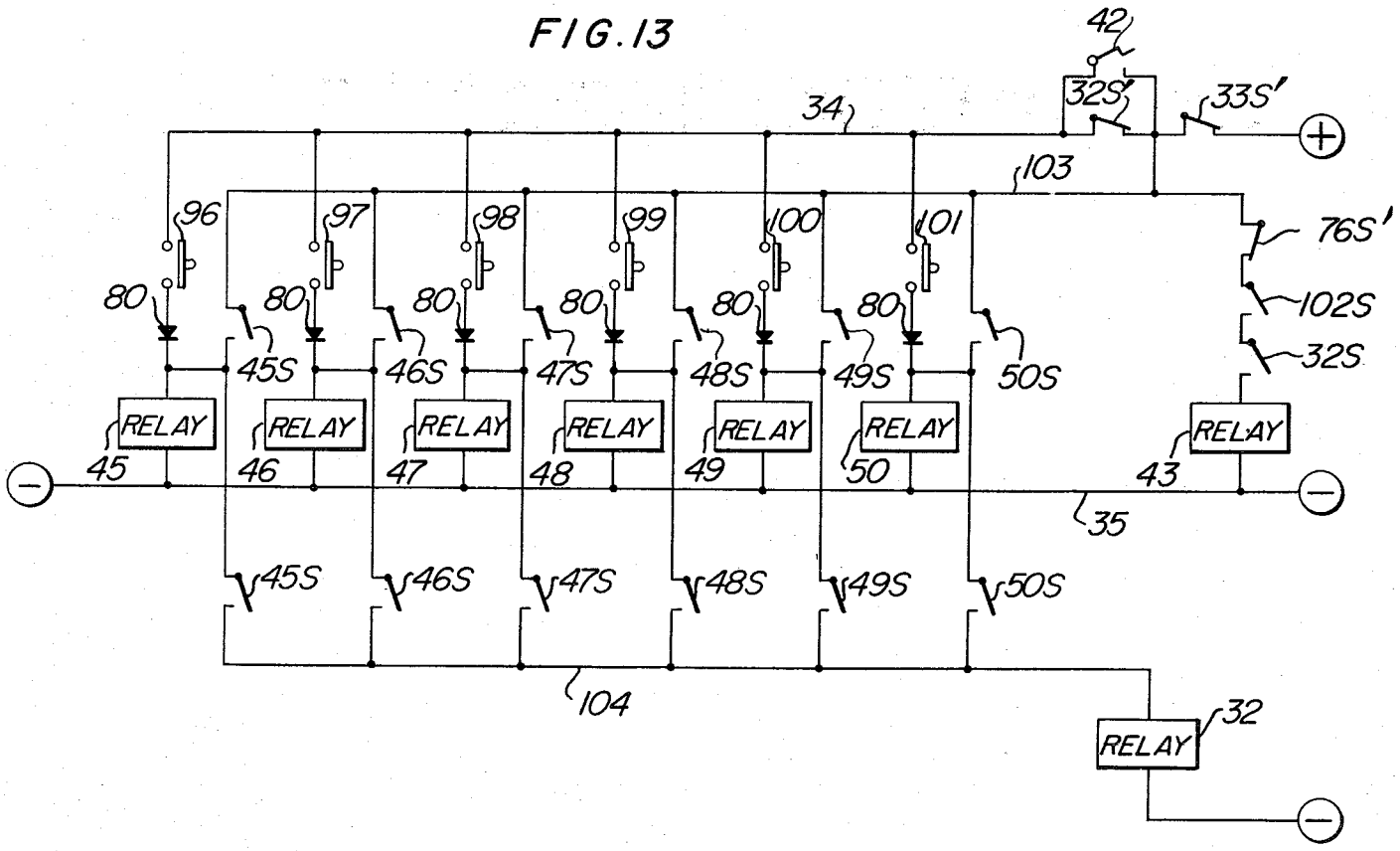
FIG. 13 is an aisle selecting circuit diagram.

Referring to FIG. 7, there is shown a shiftable floor unit selecting circuit. A conductor 44 is branched from a terminal R0 through the make contact 43S of a start instructing relay 43 shown in FIG. 13, and the break contacts 45S' . . . 50S' of aisle selection signal receiving relays 45 . . . 50 shown in FIG. 13 are connected in series with said conductor 44. Another set of the break contacts 45S' . . . 50S' are also connected in series with a conductor 51. Between the junction of the break contacts 45S' and 46S' on the conductor 44 and a conductor 62 connected to a terminal S0 is connected an electromagnetic switch 52 with the break contact 53S' of an electromagnetic switch 53 and a limit switch 20AL interposed between it and said junction, said electromagnetic switch 52 being used for rotating the motor 18 of the shiftable floor unit 3 in the normal direction (for leftward shifting) and said electromagnetic switch 53 being used for rotating the motor 18 in the reverse direction (for the rightward shifting). The electromagnetic switch 52 for rotating the motor of the shiftable floor unit 3 in the reverse direction (for rightward shifting) is connected between the junction of the break contacts 45S' and 46S' on the conductor 51 and the conductor 62, with the break contact 52S' of the electromagnet switch 52 and a limit switch 20BR interposed between it and said junction. Similarly, electromagnetic switches 54, 56, 58 and 60 for leftward shifting and electromagnetic switches 55, 57, 59 and 61 for rightward shifting, of the motors 18 of the shiftable floor units 4 . . . 7 are respectively connected between the conductor 44 or 51 and the conductor 62 in the manner described.

Figure 8:
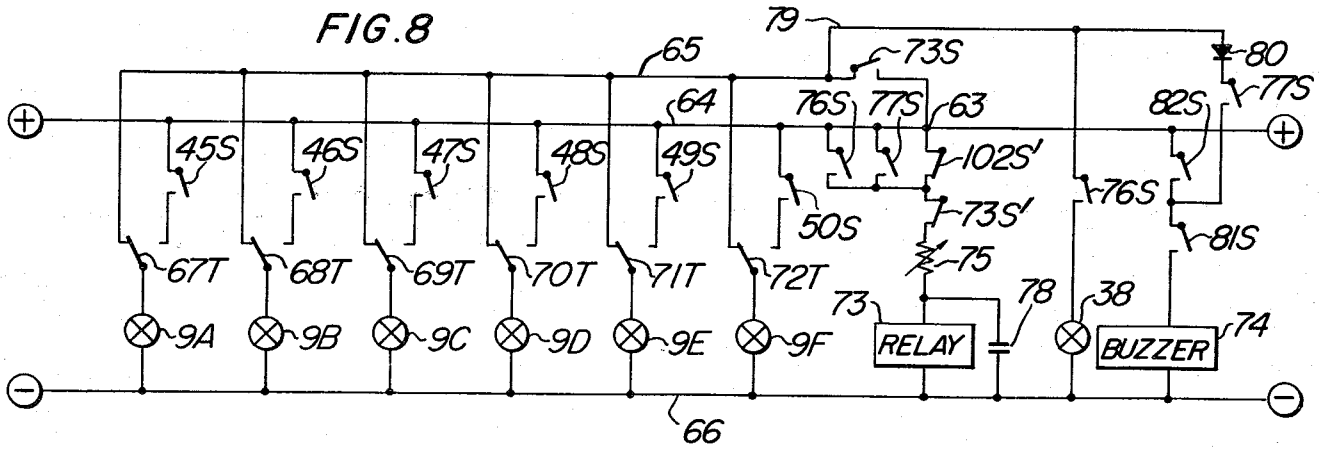
FIG. 8 is a circuit diagram for indicating the operations of aisle indicating lamps, and a warning and safety unit.

Referring to FIG. 8, there is shown a circuit for turning on the aisle indicating lamps 9A . . . 9F provided on the trucks 8 of the respective shiftable floor units 3 . . . 7 and stationary floor unit 2, and a warning and safety device operation indicating circuit. In the aisle indicating lamp lighting circuit, the lamp 9A to indicate the aisle A being opened is connected between a conductor 64 connected to a (+) terminal and a conductor 66 connected to a (−) terminal, with the make contact 45S of an aisle selection signal receiving relay 45 and the transfer contact 67T of a safety bar operation signal receiving relay 67 shown in FIG. 14 interposed between it and said conductor 64. The connection of the aisle indicating lamp 9A is switched from the make contact 45S to a conductor 65 branched from the conductor 64 at a branch point 63, by the operation of the transfer contact 67T of the safety bar operation signal receiving relay 67. Similarly, the aisle indicating lamps 9B . . . 9F for the aisles B to F are respectively connected between the conductor 66 and the conductors 64 and 65 with the make contacts 46S . . . 50S of aisle selection signal receiving relays 46 . . . 50 and the transfer contacts 68T . . . 72T of the safety bar operation signal receiving relays 68 . . . 72 interposed therebetween, the connection of said lamps 9B . . . 9F being switched from the conductor 64 to 65 or vice versa by said transfer contacts 68T . . . 72T respectively. Between the conductor 65 and branch point 53 is connected to make contact 73S of a flicker relay 73.

The warning and safety device operation indicating circuit flashes the safety device operation indicating lamp 38 to make the operation of the safety bar known to the operator and also operates a buzzer 74 to continuously or intermittently sound an alarm when a portion of the circuit is grounded to the main body or when a special operation is performed. The flicker 73 is connected between the branch point 63 and the conductor 66 with the break contact 102S' of a safety bar operation detecting relay 102, the break contact 73S' of said flicker relay 73 and a flicker adjusting variable resistor 75. The break contact 102S' of the safety bar operation detecting relay 102 has connected in parallel thereto the make contact 76S of a safety device operation memorizing relay 76 shown in FIG. 15, and the make contact 77S of a relay 77 for special operation shown in FIG. 14. A capacitor 78 is connected in parallel relation to the flicker relay 73 and the safety operation indicating lamp 38 is connected between a conductor 79 branched from the make contact 73S of the flicker relay 73 and the conductor 66, through the make contact 76S of the safety device operation memorizing relay 76. The buzzer 74 is connected between the conductors 79 and 66 in parallel relation to the make contact 76S and the safety device operation indicating lamp 38, through a back flow preventing diode 80, the make contact 77S of the special operation relay 77 and the make contact 81S of a start detecting relay 81 shown in FIG. 16. Between the make contacts 77S and 81S of this buzzer circuit, and the conductor 64, is connected the make contact 82S of a grounding relay 82.

Figure 9:
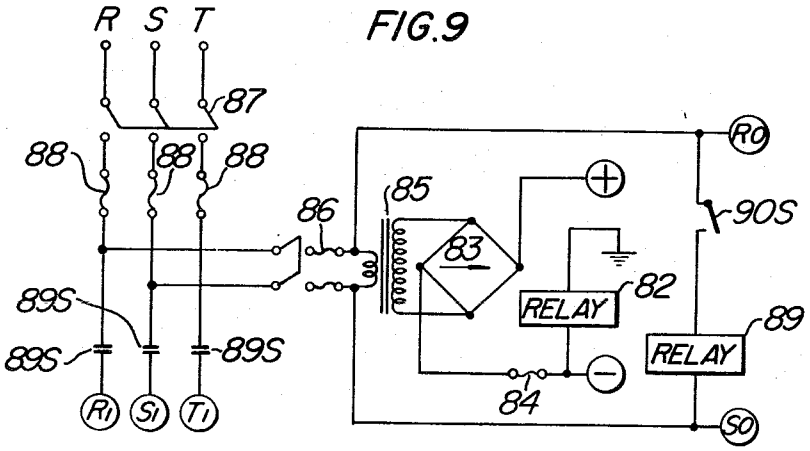
FIG. 9 is a power source circuit diagram.

FIG. 9 shows a power source circuit. As shown, a rectifier 83 is connected between the (+) terminal and the (−) terminal, with a fuse 84 interposed between it and said (−) terminal. Between the fuse 84 and the (−) terminal is connected one end of the grounding relay 82 the other end of which is grounded. The rectifier 83 has the secondary coil of a transformer 85 connected thereto and the primary coil of said transformer 85 is connected with a source switch 86 for the control circuit. The terminals R, S, T of the power source are connected to terminals R1, S1, T1 through a power source switch 87, fuses 88 and the make contact 89 of an electromagnetic switch 89 for the driving motors 18 of the shiftable floor units 3 . . . 7 respectively. The electromagnetic switch 89 is connected between the terminals R0 and S0 of the primary coil of the transformer 85 through the make contact 90S of a thermal operation detecting relay 90 shown in FIG. 12.

Figure 10:
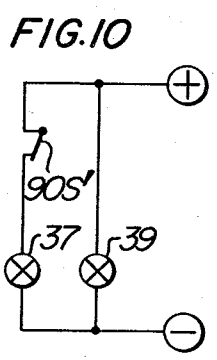
FIG. 10 is a power source and thermal operation indicating lamp circuit diagram.

FIG. 10 shows a power source and thermal operation indicating lamp circuit. The thermal operation indicating lamp 37 is connected between the (+) and (−) terminals through the break contact 90S' of a thermal operation detecting relay 90. The power source lamp 39 is also connected between the (+) and (−) terminals.

Figure 11:
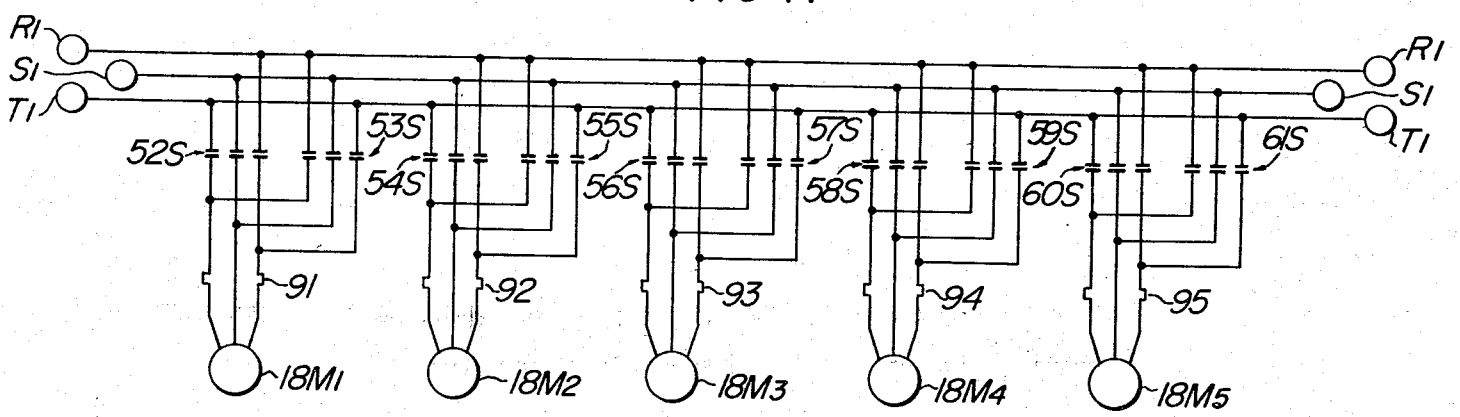
FIG. 11 is a motor circuit diagram.

FIG. 11 shows the circuit of the motors 18 for driving the respective shiftable floor units 3 . . . 7. The motors of the shiftable floor units 3, 4, 5, 6 and 7 are designated by numerals 18M1, 18M2, 18M3, 18M4, 18M5 respectively. The motors 18M1 . . . 18M5 are respectively connected to the terminals R1, S1 and T1 through thermal relays 91 . . . 95 for detecting overloading of the motors and the make contacts 52S . . . 61S of the electromagnetic switches 52 . . . 61 for rightward and leftward shifting, in the order, for example, of the make contact 52S of the electromagnetic switch 52 for rightward shifting and the make contact 53S of the electromagnetic switch 53 for leftward shifting.

Figure 12:
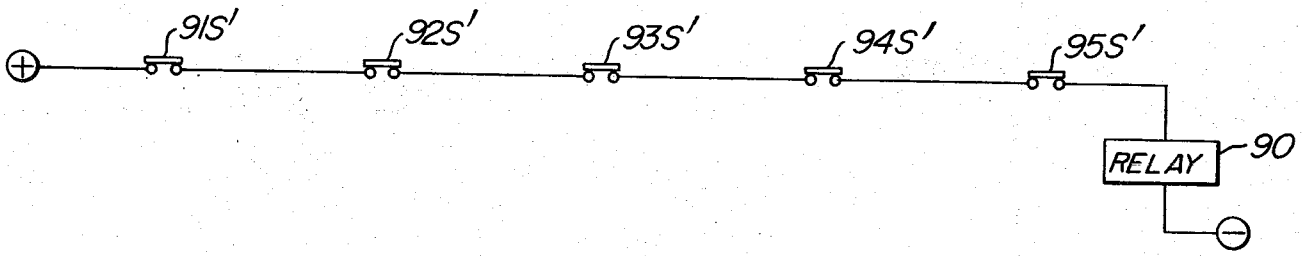
FIG. 12 is a thermal operation detecting circuit diagram.

FIG. 12 shows a circuit to detect the operations of the thermal relays for detecting overloading of the motors, in which the thermal operation detecting relay 90 for detecting the operation of any thermal relay is connected between the (+) and (−) terminals through the break contacts 91S' . . . 95S' of the thermal relays 91 . . . 95.

FIG. 13 shows a circuit which selects an aisle to be formed by operating the aisle forming operating pedals 10A . . . 10F provided on the shiftable floor units 3 . . . 7 or the aisle buttons 31A . . . 31F of the operation control device 12 provided on the stationary floor unit 2. In the circuit, the aisle selection signal receiving relays 45 . . . 50 for receiving a signal indicative of the selection of a desired aisle are respectively connected in parallel between the conductors 34 and 35 through aisle selecting switches 96 . . . 101 and the reverse-current preventing diode 80, said conductor 34 being connected to the (+) terminal through the break contact 32S' of the aisle selection memorizing relay 32 and the break contact 33S' of the restoring relay 33, and said conductor 35 being connected to the (−) terminal. The aisle selecting switches 96 . . . 101 are switched on when the aisle forming operating pedals 10A . . . 10F or the aisle buttons 31A . . . 31F are operated. The two make contacts 45S . . . 50S, connected in series with each other, of the relays 45 . . . 50 are connected in parallel between a conductor 103 connected to the (+) terminal and a conductor 104 connected to the (−) terminal through the aisle selecting relay 32. The junction of these two make contacts and the junction of the reverse-current preventing diode 80 and the relay 45 . . . 50 are also electrically connected with each other. Between the conductors 103 and 35 is connected a start indicating relay 43 through the break contact 76S' of the safety device operation memorizing relay 76 shown in FIG. 15, the make contact 102S of the safety bar operation detecting relay 102 shown in FIG. 15 and the make contact 32S of the aisle selection memorizing relay 32. The start instructing relay 43 selectively shifts the shiftable floor units upon selection of the aisle. Connected in parallel with the break contact 32S' is the interlocking releasing button 42 which has one end connected to the conductor 103. The interlocking releasing button 42 is a switching button which is used when a plurality of aisles are desired to be formed.

Figure 14:
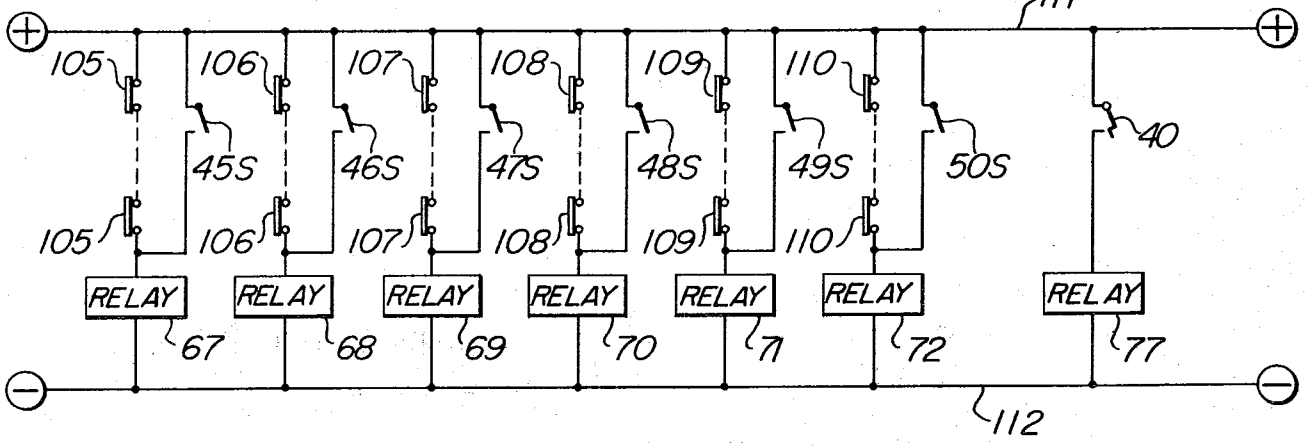
FIG. 14 is a safety bar circuit diagram.

FIG. 14 shows a circuit for receiving a signal indicative of the fact that the safety bars 23 provided on the stationary floor units and the shiftable floor units are operated. The circuit includes safety bar operation signal receiving relays 67 . . . 72 for receiving a signal indicative of the fact that the safety bar 23 is pushed by an obstacle. These relays 67 . . . 72 are connected in parallel between a conductor 111, connected to the (+) terminal, and a conductor 112 connected to the (−) terminal, through safety bar switches 105 . . . 110 which are operated by the safety bars 23 when said safety bars 23 are pushed, respectively. Connected in parallel to these switches are the make contacts 45S . . . 50S of the respective aisle selection signal receiving relays 45 . . . 50. Further, a relay 77 for special operation is connected between the conductors 111 and 112 through the special operation push button 40 of the operation control device shown in FIG. 6. The special operation relay 77 enables the shiftable floor units to be shifted by pushing the button 40, even when the safety bars are in the operated positions.

Figure 15:
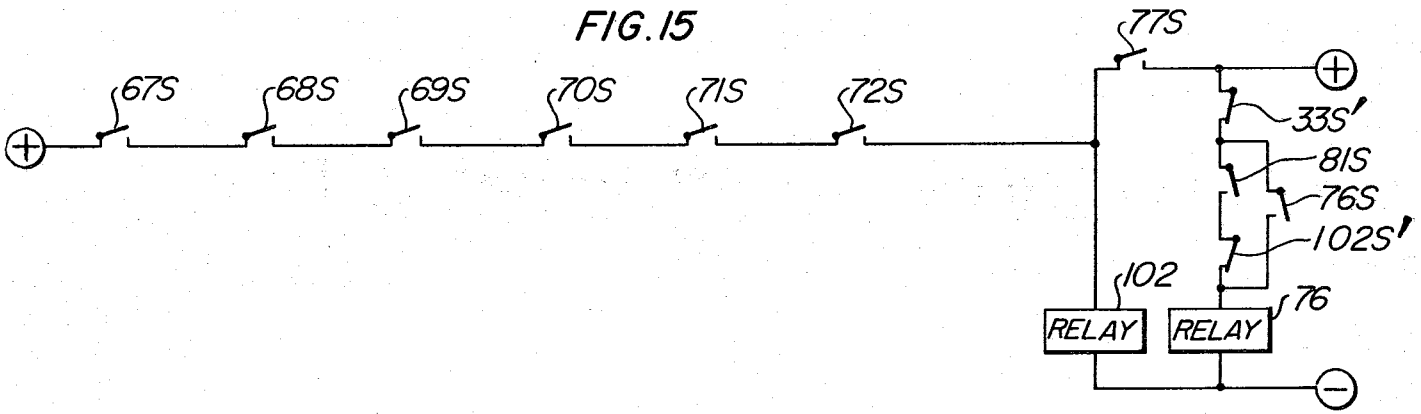
FIG. 15 is a safety bar operation detecting circuit diagram.

In FIG. 15 is shown a circuit for detecting the operation of the safety bar. The circuit includes the safety bar operation detecting relay 102 which is connected to the (+) terminal through a series circuit of the make contacts 67S . . . 72S of the safety bar operation signal receiving relays 67 . . . 72, and also with the (−) terminal through the make contact 77S of the special operation relay 77 in parallel relation with said series circuit of the make contacts. The circuit also includes the safety device operation memory relay 76 which is also connected between the (+) and (−) terminals through a series circuit of the break contact 33S' of the restoring relay 33 shown in FIG. 17, the make contact 81S of a start detecting relay 81 shown in FIG. 16 and the break contact 102S' of the safety bar operation detecting relay 102. The make contact 76S of the safety device operation memorizing relay 76 is connected in parallel to the series circuit of the make contact 81S and the break contact 102S'.

Figure 16:
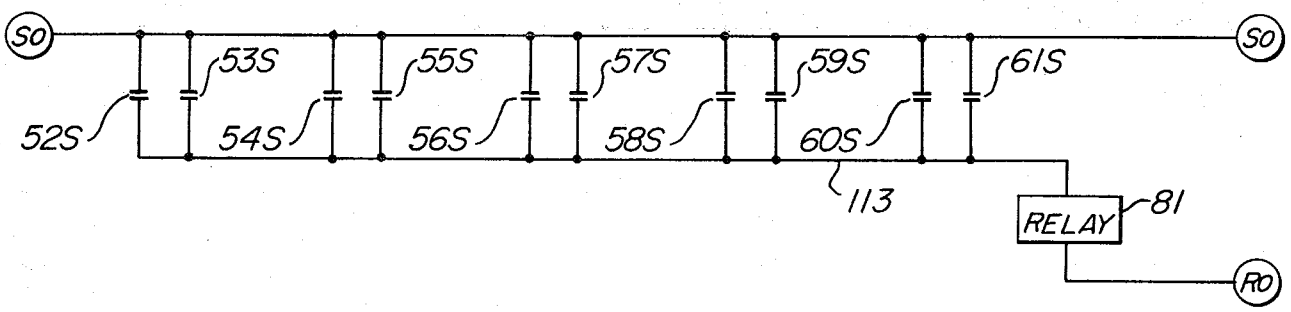
FIG. 16 is a shiftable floor unit start detecting circuit diagram.

FIG. 16 shows a circuit for detecting the start of the shiftable floor units, and in this circuit the make contacts 52S . . . 61S of the electromagnetic switches 52 . . . 61 for leftward and rightward shifting are connected in parallel between the terminal SO and a conductor 113 which is connected to the terminal RO through the start detecting relay 81 for detecting the start of the motor.

Figure 17:
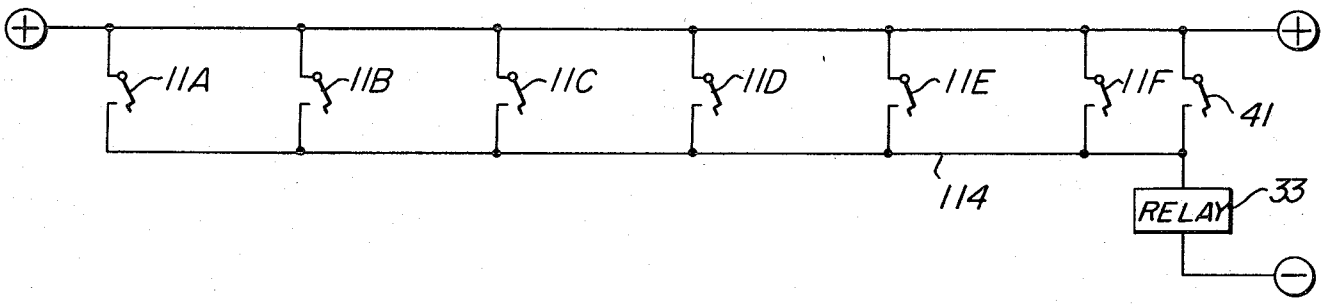
FIG. 17 is a restoring circuit diagram.

FIG. 17 shows a restoring circuit for restoring the control circuit. In this circuit, the restoring pedals 11A . . . 11F provided on the shiftable floor units 3 . . . 7 and stationary floor unit 2, and the restoring button 41 of the operation control device 12 are connected in parallel between the (+) terminal and a conductor 114 which is connected to the (−) terminal through the restoring relay 33 for restoring the control circuit.

In the foregoing description, the character S suffixed to each reference numeral of the contact of each relay or switch, represents the make contact, S' the break contact and T the transfer contact of said relay or switch. The terminal indicated by one reference character is connected with the terminals of the same reference character.

In operating the shiftable article storage device constructed as described above, the power source switch 87 of the power source circuit of FIG. 9 is closed and then the power source switch 86 of the control circuit is closed (this power source switch 86 may be held closed constantly). As a result, current flows from the terminals R, S, T of the three-phase power source through the switch 87, the fuses 88 and the switch 86, and a single-phase A.C. voltage appears across the terminals RO and SO. Further, the current is transformed by the transformer 85 and rectified by the rectifier 83, and a D.C. voltage appears across the (+) and (−) terminals, by which the power source lamp 39 shown in FIG. 10 is turned on. Furthermore, the thermal operation detecting relay 90 of FIG. 12 and the safety bar operation detecting relays 67 . . . 72 of FIG. 14 are actuated respectively, with the result that the make contacts thereof are closed, the break contacts thereof are opened and the transfer contacts thereof are switched to the opposite side. The closure of the make contact 90S in FIG. 9 results in actuation of the electromagnetic switch 89 and also the safety bar operation detecting relay 102 of FIG. 15. Thus, the make contact 89S of the electromagnetic switch 89 is closed in the power source circuit of FIG. 9 and the three-phase voltage is applied to the motor circuit. On the other hand, the make contact 102S of the relay 102 is closed and the break contact 102S' thereof is opened.

In the state of FIG. 1 wherein the aisle E is formed, the limit switches 20AL, 20BL, 20CL, 20DL and 20FR of the respective shiftable floor units are held opened as shown in FIGS. 5 and 7, with their switching bars engaged by the projections 21AL, 21BL, 21CL, 21DL and 21FR respectively.

Then, the aisle forming operating pedal 10C of the shiftable floor unit 5 or the aisle button 31C of the operation control device 12 is actuated to form the aisle C. By actuating the pedal 10C or the aisle button 31C, the aisle selecting switch 98 of FIG. 13 is closed and the circuit extending from the (+) terminal through the break contact 33S' of the restoring relay 33, the break contact 32S' of the aisle selection memorizing relay 32, the conductor 34, the aisle selecting switch 98, the back flow preventing diode 80, the aisle selection signal receiving relay 47 to the (−) terminal is closed, whereby said relay 47 is actuated and self-holds with its make contact 47S closed, and the aisle selection memorizing relay 32 is also actuated. Upon actuation of the relay 32, the start instructing relay 43 is actuated by the current supplied thereto from the (+) terminal through the break contacts 33S' and 76S' and the make contacts 102S and 32S, and the make contact 43S of said relay 43 is closed. Further, the aisle indicating lamp 9C of FIG. 8 is turned on upon closure of the make contact 47S.

In the safety bar circuit of FIG. 14, since the make contact 47S is closed, the safety bar switch 107 connected in parallel thereto is opened when its safety bar is pushed. However, since the operating circuit for the safety bar operation signal receiving relay 69 is closed at the make contact 47S, the relay 69 is not sensitive to the closure of the safety bar switch 107. In other words, the safety bar facing the aisle being formed is not pushed by anything and hence is held ineffective.

In the shiftable floor unit selecting circuit of FIG. 7, on the other hand, the break contact 47S' is opened and the make contact 43S is opened, so that the operating circuits for the electromagnetic switches 52 and 54 to rotate the motor in the normal direction for leftward shifting and the electromagnetic switches 57, 59 and 61 to rotate the motor in the reverse direction for rightward shifting are electrically selected. However, since the limit switches 20AL, 20BL and 20FR are opened in the state of FIG. 1 as stated above, the operating circuits for the electromagnetic switches 52 and 54 for leftward shifting and the electromagnetic switch 61 for rightward shifting are not actuated as their operating circuits are not closed. On the other hand, the limit switches 20DR and 20ER are closed and therefore, the operating circuits for the electromagnetic switches 57 and 59 for rightward shifting are closed. The actuation of the electromagnetic switches 57 and 59 for rightward shifting results in opening of the break contacts 57S' and 59S', releasing of the interlocking with the electromagnetic switches 56 and 58 for leftward shifting and closing of the make contacts 57S and 59S in FIG. 11, so that the motors 18M3 and 18M4 are rotated in the reverse direction and the shiftable floor units 5 and 6 are shifted to the right as viewed in FIG. 1. When the shiftable floor units 5 and 6 reach the ends of their rightward strokes, the limit switches 20DR and 20ER are opened by engagement with the projections 21DR and 21ER respectively, whereby the operating circuits for the electromagnetic switches 57 and 59 for rightward shifting are broken and the motors 18M3 and 18M4 are stopped. Therefore, the shiftable floor units 5 and 6 are brought to a halt.

After the aisle C has been formed in the manner described, a pallet 24 is placed on or taken out from the shiftable floor unit 4 or 5 through the aisle C. Thereafter, either the restoring pedal 11A . . . 11F or the restoring push button 41 is depressed, whereupon the restoring relay 33 in FIG. 17 is actuated and its break contact 33S' is opened. Therefore, since the break contact 33S' is opened in FIG. 13, the self-holding circuit of the aisle selection signal receiving relay 47 restores its open state, and the aisle selection memorizing relay 32 and the start instructing relay 43 also restore their original states, so that the control circuit is returned to its original state, providing for the next aisle selecting operation.

Next, the operation of the safety device will be explained. When the safety device is actuated upon abutment of the safety bar against an obstacle present in the aisle E during the normal operation, the safety bar switch 109 in the safety bar circuit of FIG. 14 is opened, with the result that the operating circuit for the safety bar operation signal receiving relay 71 is opened and said relay 71 restores its initial state. Therefore, the make contact 71S of the safety bar operation detecting circuit of FIG. 15 is opened to break the operating circuit for the safety bar operation detecting relay 102 and thus said relay 102 restores its initial position. On the other hand, since the make contacts 57S and 59S of the electromagnetic switches 57 and 59 in the start detecting circuit of FIG. 16 are held closed, the operating circuit or the start detecting relay 81 is closed, holding said relay 81 in the actuated position. Therefore, the make contact 81S in the operating circuit for the safety device operation memorizing relay 76 of the safety bar operation detecting circuit is held closed. Since the break contact 102S' is closed at the point when the relay 102 is restored, the operating circuit for the relay 76 is closed and the relay 76 self-holds with its make contact 76S closed.

In the aisle selecting circuit of FIG. 13, the make contact 102S and the break contact 76S' in the operating circuit for the start instructing relay 43 are opened to restore the relay 43. Therefore, the make contact 43S in the shiftable floor unit selecting circuit of FIG. 7 is opened, and the make contacts 57S and 59S in the motor circuit of FIG. 11 are opened to stop the motors 18M3 and 18M4 to bring the shiftable floor units 5 and 6 to a halt.

On the other hand, in the warning circuit of FIG. 8, the break contact 102S' and the make contact 76S are closed, so that the operating circuit of the flicker relay 73 is closed and said relay 73 is actuated with a time delay through the variable resistor 75. Upon actuation of the relay 73, the break contact 73S' thereof is opened to break the operating circuit for said relay 73. However, the relay 73 is held in its actuated position for a certain period of time by the dischrage current of the capacitor 78, before it is restored. Thereafter, the relay 73 is flickered in the same manner. In the indicating lamp 9E to indicate the aisle E, the transfer contact 71T is also switched to its restored position, so that said lamp 9E is also flashed incidentally to flickering of the make contact 73S. Similarly, the safety device operation indicating lamp 38 also flashes incidentally to flickering of the make contact 73S in FIG. 8, since said make contact is held closed.

After the shiftable floor units have been stopped, the obstacle is removed and the safety bar is returned to its normal position. Therefore, the normal shifting operation can be resumed again by pushing the desired aisle button after actuation of the restoring button. Where it is impossible to remove the obstacle, the aisle pedal 10E or the aisle button 31E is depressed after the restoring button has once been depressed. In this case, since the safety bar in the aisle being opened is held inoperable as stated above, the shiftable floor units 5 and 6 are shifted to the left as viewed in FIG. 1, in the same manner as in the normal operation described above.

When the safety bars are actuated in a plurality of aisles, or the safety bar is inoperative due to malfunction is held in its retracted position upon removal of the obstacle, it is impossible to form the aisle by the normal operation described above. In this case, the special operation button 40 is used. Namely, the special operation button 40 is depressed for a while continously, whereby the special operation relay 77 in FIG. 14 is actuated and its make contact 77S in FIG. 15 is closed. The operating circuit for the safety bar operation detecting relay 102 is closed through the make contact 77S, so that said circuit is isolated from the operating circuits operated by the make contacts 67S . . . 72S of the safety bar operation signal receiving relays 67 . . . 72 for the respective aisles. Therefore, the aisle can be opened in the same manner as described above, by depressing the aisle button. When the special operation button 40 is held in the depressed position, the safety bar is not operative but the buzzer 74 intermittently sounds an alarm by the function of the flicker relay 73. After the aisle is opened in the manner described, the obstacle is removed and then the restoring button and the desired aisle button are depressed in the order mentioned.

When overcurrent flows through the motor, the pertinent one of the thermal relays 91 . . . 95 of the motor is actuated and the thermal operation detecting relay 90 in FIG. 12 is restored, and its make contact 90S is opened and its break contact 90S' is closed. Therefore, the electromagnetic switch 89 in FIG. 9 is restored to break the motor circuit and flash the thermal operation indicating lamp 37 in FIG. 10, making the condition known to the operator.

When it is desired to form a plurality of aisles concurrently, e.g. to form the aisle D concurrently with the aisle C, the interlocking releasing button 42 in FIG. 6 is pushed and the aisle button 31C of the operation control device 12 is pushed thereafter, whereupon the shiftable floor units 5 and 6 are shifted to the right as viewed in FIG. 1 in the manner described above. Then, the aisle button 31D is pushed at the point when the aisle C has been opened to a certain width. In the case of forming only one aisle, the aisle selection memorizing relay 32 is actuated, with its break contact 32S' shown in FIG. 13 opened, so that the other shiftable floor units are not operative, even when their aisle pedals or buttons are actuated to instruct the formation of the other aisles, as described previously. However, when the interlocking releasing button 42 is previously actuated, the circuit leading from the (+) terminal to the conductor 34 through the button 42 is closed. Therefore, when the aisle button 31D is pushed, the aisle selecting switch 99 is closed and the aisle selection signal receiving relay 48 is actuated and self-held. The aisle indicating lamp 9D is flashed by the operation of the relay 48. In FIG. 7, on the other hand, the break contact 48S' is opened and the electromagnetic switch 57 for rightward shifting is restored which has been actuated, so that its make contact 57S is opened to stop the motor 18M3. The shiftable floor unit 5 is brought to a halt but the shiftable floor unit 6 continutes to move and is brought to a halt when the limit switch 20ER is actuated by the projection 21ER. Thus, the aisles C and D are formed simultaneously.

The grounding relay 82 in FIG. 9 is actuated when a portion of the circuit is grounded to the main body, and its make contact 82S closes the operating circuit for the buzzer 74 to sound an alarm. The alarm in this case is a continuous sound.

According to the first embodiment of the shiftable article storage device of the invention, the storage capacity of a limited space can be increased by disposing a large number of shiftable floor units in said space and each shiftable floor unit can be moved positively even when heavy articles are mounted thereon as each floor unit is provided with its own driving source. Furthermore, the aisle can be selectively formed at a desired location by the same operation, in not only the case when the shiftable floor units are neatly arranged with only one aisle formed at a location but also the case when the shiftable floor units are arranged irregularly as a result of the multiple-aisle-forming operation. In addition, the operation of the storage device can be stopped instantaneously by the safety device when an abstacle is present in the aisle being closed.

FIGS. 18 to 39 shown the second embodiment of the present invention in which the article storage units are shiftable stack units. In this embodiment, the shiftable stack units are each provided on the confronting faces thereof with a limit switch as means for detecting the engagement and disengagement of the adjacent shiftable stack units, said limit switch being held in an ON-position when the adjacent stack units are spaced from each other and held in an OFF-position when they are in contact with each other. Further, in this embodiment aisle width control means is provided to control the width of the aisle to be formed and an arrangement is made so that two aisles may be formed concurrently.

Figure 18:
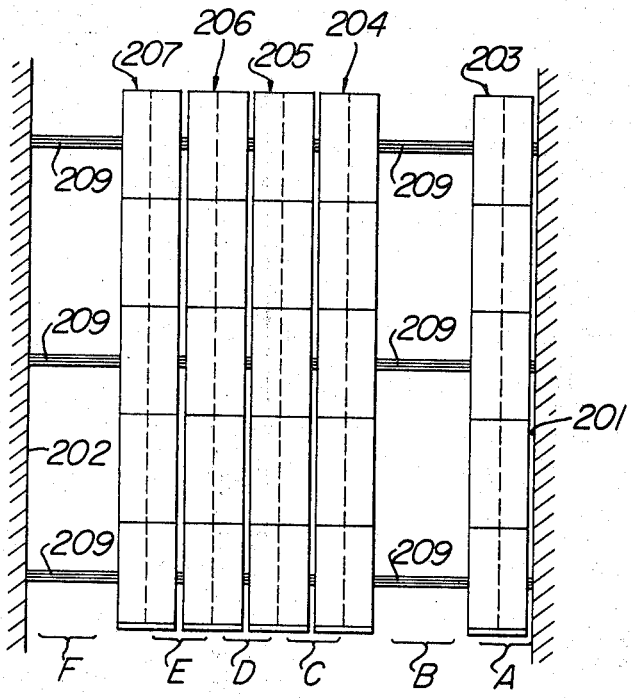
FIG. 18 is a plan view of the second embodiment of the invention in which shiftable stack units each having a plurality of shelves are used as article storage units.
Figure 19:
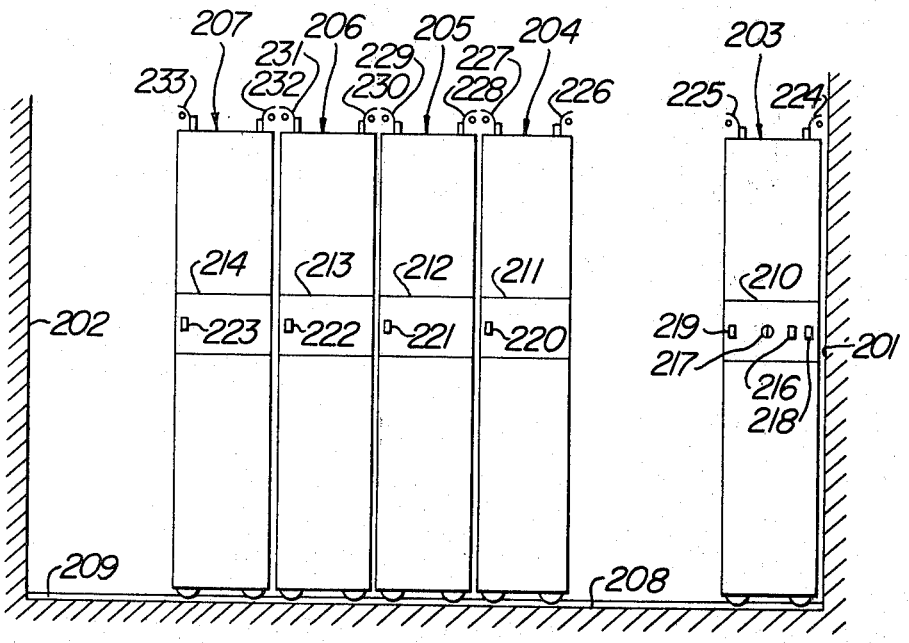
FIG. 19 is a front view of the shiftable stack unit.

As shown in FIGS. 18 and 19, five shiftable stack units 203, 204, 205, 206 and 207 are arranged between the side walls 201 and 202 of a warehouse of the like in such a manner that they are horizontally movable on three guide rails 209 provided in the floor 208 of the warehouse or the like. Reference characters A . . . F indicate aisles to be formed upon shifting of the shiftable stack units, and the aisles B and F are formed in the illustration of FIG. 18. In this embodiment, as will be apparent from FIGS. 18 and 19, reference numerals of the shiftable stack units and reference characters of the aisle are given from right to left.

as shown in FIG. 19, on the side wall of the shiftable stack unit 203 is provided a control board 210 which has a power source switch 216 and a special operation switch 217 at the center, an aisle switch 218 for the aisle A on the right side and an aisle switch 219 for the aisle B on the left side thereof. Each of control boards 211 . . . 214 provided on the shiftable stack units 204 . . . 207 has aisle switches 218 . . . 223 provided on the left side thereof respectively. The power source switch 216 has one lamp and the aisle switches 218 . . . 223 each have two lamps therein respectively (though not shown in FIG. 19). These switches are of the seesaw type or snap type. Further, the shiftable stack units 203 . . . 207 are respectively provided with aisle illuminating lamps 224 . . . 233 on the top walls thereof. Namely, the shiftable stack unit 203 has the illuminating lamp 224 on the right side of the top wall for illuminating the aisle A and the illuminating lamp 225 on the left side thereof for illuminating the aisle B, and the shiftable stack unit 204 has the illuminating lamp 226 for illuminating the aisle B and the illuminating lamp 227 for illuminating the aisle C, and so on. The arrangement is made such that, when an aisle is formed, the illuminating lamps on the shiftable stack units on the opposite sides of said aisles are lit. It is possible to arrange such that lamps provided on the side walls 201 and 202 (though not shown in FIG. 19) may be lit when the aisles A and F are formed.

Figure 20:
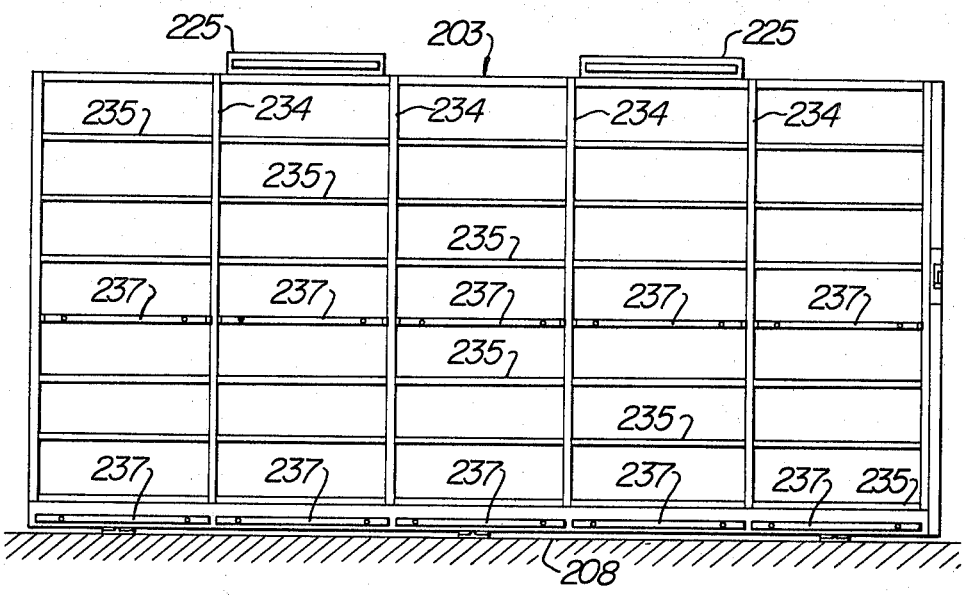
FIG. 20 is a side view showing the details of the shiftable stack unit.

Each shiftable stack unit has two storage sections separated in the shifting direction at the center thereof as indicated by the dotted line in FIG. 18 and each storage section is divided into five lateral sub-sections and seven vertical sub-sections by posts 234 and shelf boards 235 respectively as shown in FIG. 20. The fourth shelf board 235 and a truck 236 are each provided with spring-biased safety bars 237.

Figure 21:
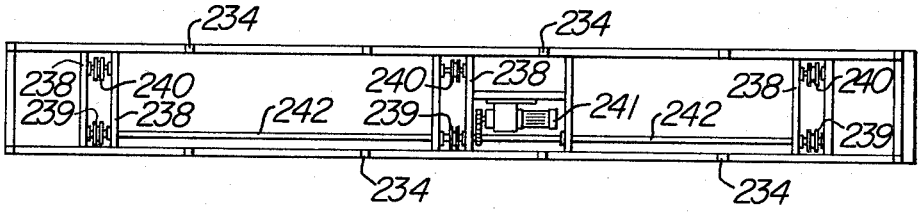
FIG. 21 is a plan view showing the truck of the shiftable stack unit.

Similar to the first embodiment described above, the truck 236 is reinforced by a plurality of transverse girders 238 as shown in FIG. 21 and has driving wheels 239 and follower wheels 240 rotatably mounted thereon for rolling on the guide rails 209. The driving wheels 239 are fixedly mounted on a driving shaft 242 which is driven by a motor 241 mounted on the truck 236.

Figure 22:
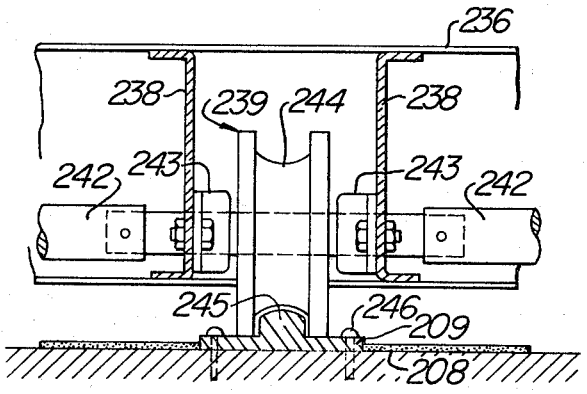
FIG. 22 is a view showing the wheel mounted on the truck frame and a guide rail.

FIG. 22 shows the relative position of the driving wheel 239 of the truck 236 and the guide rail 209 shown in FIG. 21. As shown, the driving wheel 239 is rotatably supported by bearings 243 between the transverse girders 238 and has an annular recess 244 along the center of the peripheral surface thereof, in which a central projection 245 of the guide rail 209 is received. The guide rail 209 is secured to the floor 208 by anchor bolts 246. The follower wheel 240 is also rotatably supported on the transverse girders by means of bearings in the same manner as the driving wheel 239 though not shown in the Figure.

FIGS. 23 to 26 shows the details of the limit switch for stopping the stack unit when said stack unit is brought into engagement with the adjacent stack unit, and the aisle width control means for stopping the stack unit when the aisle being formed has reached a predetermined width. With reference first to the limit switch, the shiftable stack unit 203 is provided at the lower portion of the side facing the aisle A with a limit switch 252 which is adapted to be placed in an OFF-position when engaged by a projection 247 provided on the side wall 201 and placed in an ON-position when disengaged from said projection, and at the lower portion of its side facing the aisle B with a limit switch 253, similar to the limit switch 252, for engagement with a projection 249 on the shiftable stack unit 204, and a projection 248 for engagement with a limit switch 254 provided on the shiftable stack unit 204. The shiftable stack unit 204 is provided at the lower portion of its side facing the aisle C with a limit switch 255 for engagement with a projection 205 on the shiftable stack unit 205 and a projection 250 for engagement with the limit switch 256 on the shiftable stack unit 205. Similarly, the shiftable stack units 205, 206 and 207 are respectively provided with limit switches 257, 258, 259, 260 and 261 and projections for engagement with said respective limit switches (though not shown in FIGS. 23 and 25).

Figure 23:
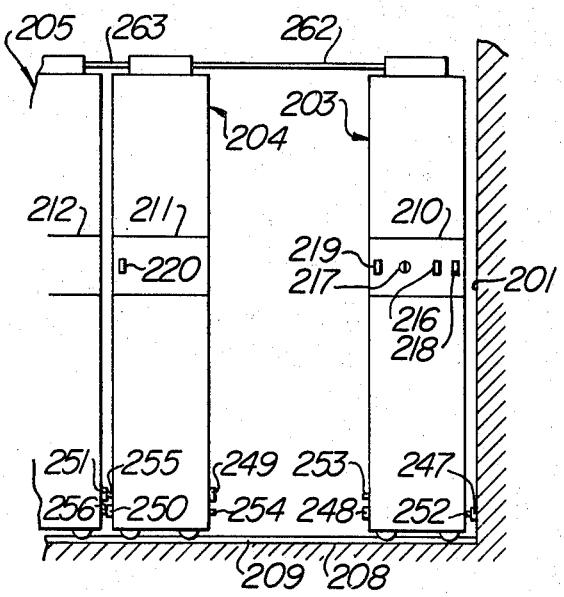
FIG. 23 is a front view showing limit switches provided at the lower portion and aisle width control means provided at the upper portion of the shiftable stack unit.
Figure 25:
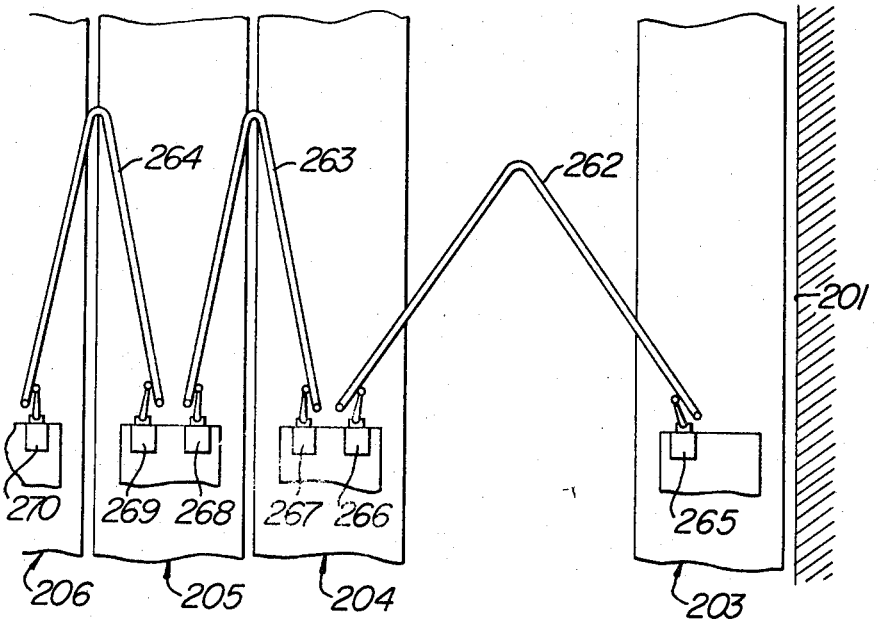
FIG. 25 is a view showing the details of the aisle width control means of the shiftable stack unit, in the state wherein the shelf units are spaced to form an aisle.
Figure 26:
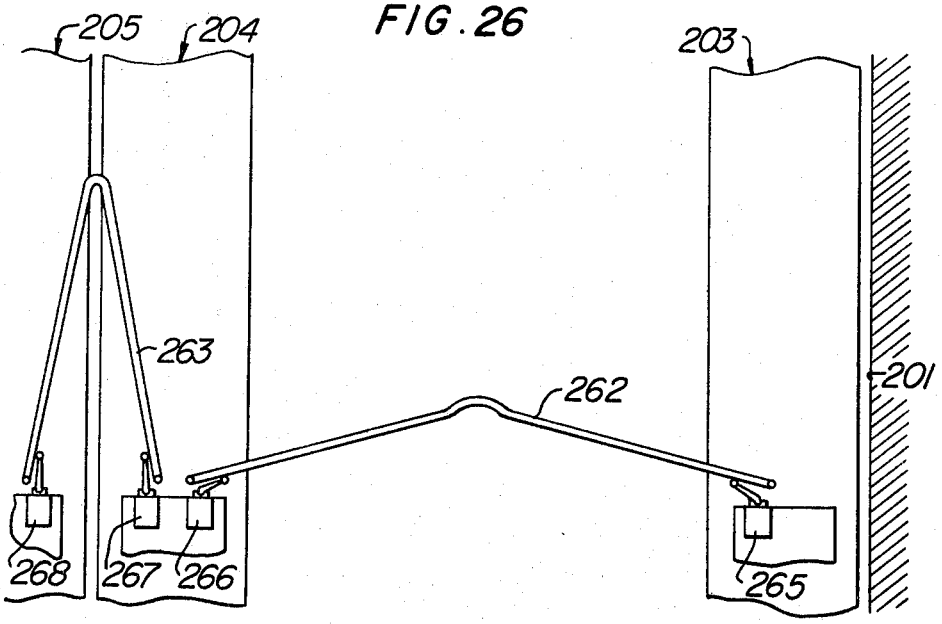
FIG. 26 is a view showing the state wherein the function of the aisle width control means is released and the shelf units are fully opened.

The aisle width control means is provided on the top wall of each shiftable stack unit as shown in FIGS. 23, 25 and 26. With reference to the aisle B, an arm 262 flexible at the center thereof is provided across the aisle B, with the opposite ends thereof pivotally connected to the shiftable stack units 203 and 204, and aisle width control switches 265 and 266 are provided on the shiftable stack units 203 and 204 adjacent the pivoted ends of said arm 262 so as to be actuated by said arm 262. Similarly, an arm 263 is provided extending between the shiftable stack units 204 and 205 and limit switches 267 and 268 are provided on said shiftable stack units 204 and 205 to be actuated by said arm 263 respectively. The shiftable stack units 205 and 206 have an arm 264 therebetween and are provided with limit switches 269 and 270 respectively to be actuated by said arm. In the same manner, the shiftable stack units 206 and 207 have an arm therebetween and limit switches 271 and 272 respectively, and so on, though not shown in FIGS. 23, 25 and 26. Each arm is a hollow tubular body and a conductor is extended therethrough for electrical connection between the adjacent stack units, though not shown. The limit switches each are of such a type that they are held in an ON-position when the associated stack units are in a relative position such as that of the stack units 204 and 205 or 205 and 206, and in an OFF-position when the associated stack units are in a relative position such as that of the stack units 203 and 204 in FIG. 25.

Figure 27:
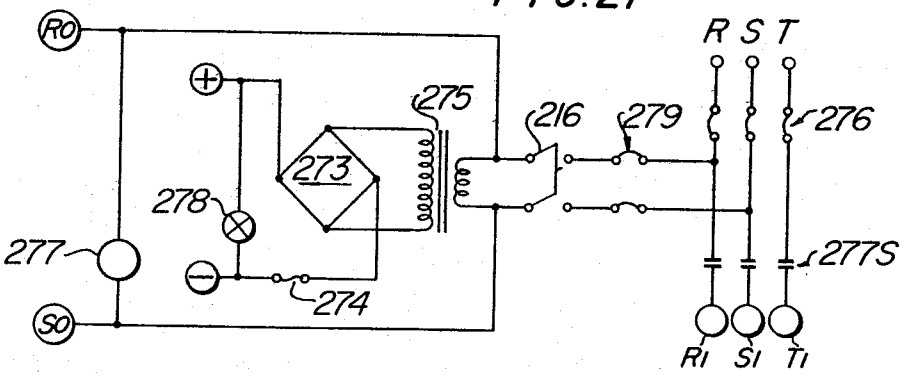
FIG. 27 is a power source circuit diagram.

FIG. 27 shows a power source circuit and a rectifier 273 connected between the (+) and (−) terminals of a power source through a fuse 274. The rectifier 273 is also connected to the secondary coil of a transformer 275, the primary coil of which is connected to the power source switch 216 of the shiftable stack unit 203. The terminals R, S and T of the three-phase power source are respectively connected to terminals R1, S1 and T1 through no-fuse breakers 276 and the make contacts 277S of electromagnetic switch 277 through which the motors on the respective shiftable stack units are connected to the power source. The electromagnetic switch 277 is connected between the terminals RO and SO of the primary coil of the transformer 275. A power source indicating lamp 278 is connected between the (+) and (−) terminals and accommodated in the power source switch 216 on the shiftable stack unit 203 as stated previously. The power source switch 216 is connected to conductors leading from the terminals R and S, through no-fuse breakers 279.

Figure 28:
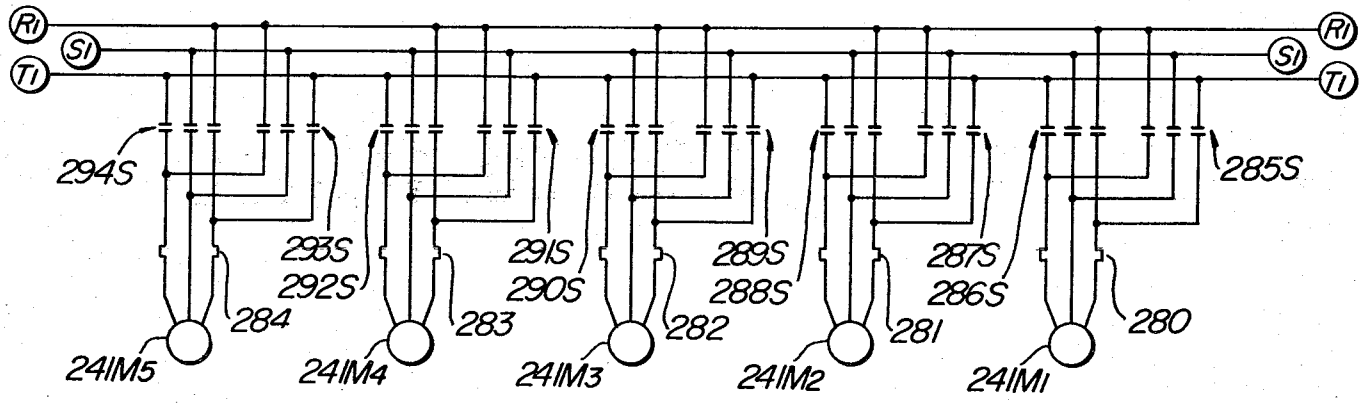
FIG. 28 is a circuit diagram of a motor to drive the shiftable stack unit.

FIG. 28 shows a motor circuit for driving each shiftable stack unit, and the motor on the shiftable stack unit 203 is indicated by reference numeral 241M1 and similarly, the motors on the other shiftable stack units are indicated by reference numerals 241M2, 241M3, 241M4 and 241M5 respectively; thermal relays for detecting overloading of the respective motors are indicated by reference numerals 280 . . . 284 respectively; and the make contacts of electromagnetic switches for rightward and leftward shifting are indicated by reference numerals 285S . . . 294S respectively. The electrical connections of these elements are the same as that of the first embodiment shown in FIG. 11, except that the order of connection is different.

Figure 29:
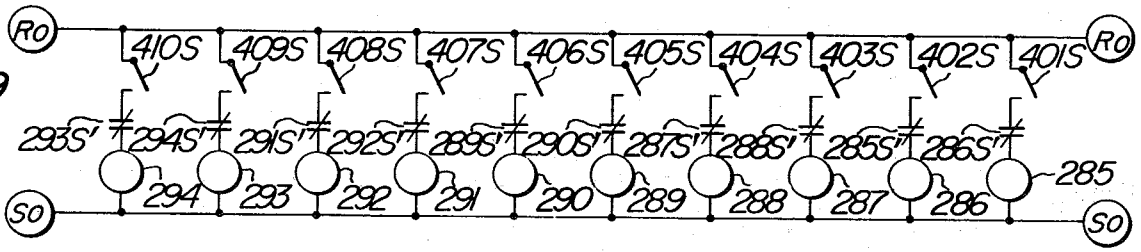
FIG. 29 is a circuit diagram of an electromagnetic switch for the motor.

FIG. 29 shows a circuit to operate the electromagnetic switches 285 . . . 294 for the motors. The electromagnetic switch 285 of the motor 241M1 for rightward shifting is connected between the terminals RO and SO through the make contact 401S of an electromagnetic switch auxiliary relay 401 for rightward shifting and the break contact 286S' of the electromagnetic switch 286 for leftward shifting. The electromagnetic switch 286 of the motor 241M1 for leftward shifting is connected between the terminals RO and SO through the make contact 402S of an electromagnetic switch auxiliary relay 402 for leftward shifting and the break contact 285S' of the electromagnetic switch 285 for rightward shifting, in parallel relation to said electromagnetic switch 285. The electromagnetic switches 287 . . . 294 of the motors 241M2 . . . 241M5 for rightward and leftward shifting, similar to that of motor 241M1, are connected between the terminals RO and SO through the make contacts 403S . . . 410S of electromagnetic switch auxiliary relays 403 . . . 410 and electromagnetic switches 288S', 287S' . . . 294S' and 293S' for reverse shifting respectively, in parallel relation to the electromagnetic switch 285.

Figure 30:
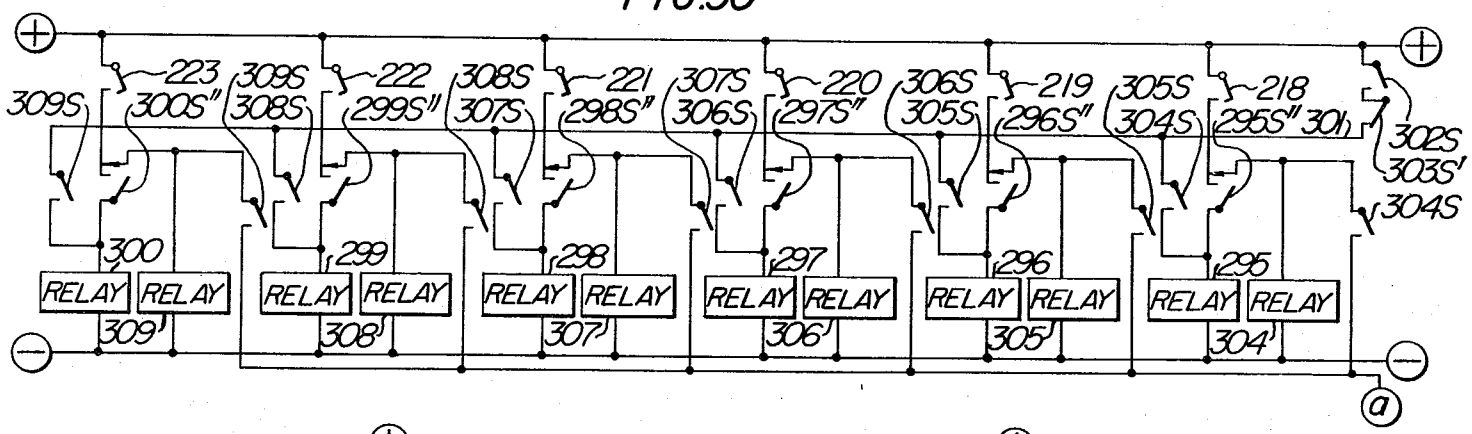
FIG. 30 is a circuit diagram of an aisle seleting circuit to select an aisle to be formed.
Figure 36:
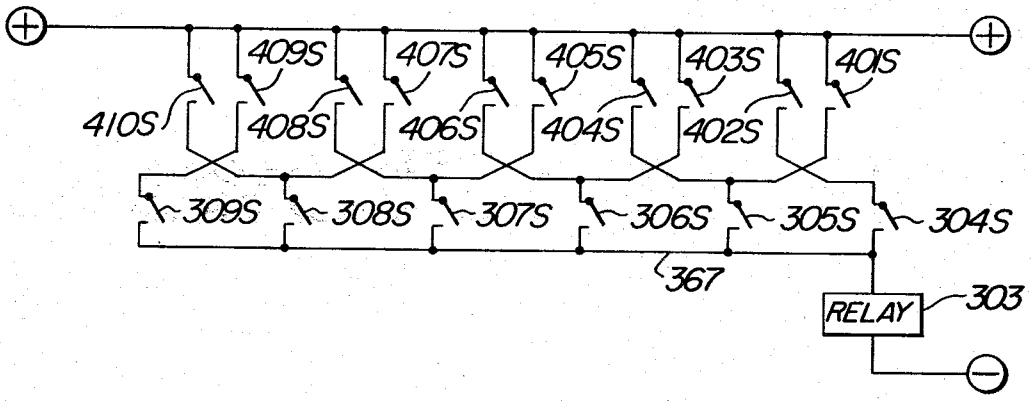
FIG. 36 is a circuit diagram of a shifting detecting circuit for detecting the shiftable stack unit being shifted.

FIG. 30 shows an aisle selecting circuit for the shiftable stack units, in which the aisle switches 218 . . . 223 provided on the respective control boards 210 . . . 214 shown in FIG. 19 are connected between the (+) and (−) terminals through aisle locking relays 295 . . . 300 and make contacts of make-before-break contacts 295S'' . . . 300S'' respectively. These aisle locking relays 295 . . . 300 are each adapted to break the electromagnetic switches of the motors on the adjacent shiftable stack units at the point when the aisle has been completely formed between said stack units, and restore the aisle selecting circuit. Namely, by these relays, the shiftable stack units on both sides of the formed aisle are locked, to provide for the selection of another aisle. To a conductor 301 which is connected between the (+) terminal and the aisle switch 218 through the make contact 302S of a locking delay relay 302 shown in FIG. 31 and the break contact 303S' of a shift detecting relay 303 shown in FIG. 36, are connected the make contacts 304S . . . 309S of aisle selection signal receiving relays 304 . . . 309 in parallel relation. The other ends of these make contacts 304S . . . 309S are respectively connected between the aisle locking relays 295 . . . 300 and the make-before-break contacts 295S" . . . 300S" thereof. The aisle selection signal receiving relays 304 . . . 309 for receiving a signal indicative of the selection of aisle are respectively connected in parallel between the break contact sides of the make-before-break contacts 295S" . . . 300S" and the (−) terminal, and another make contacts of said aisle selection signal receiving relays 304 . . . 309 are respectively connected between the break contact sides of the make-before-break contacts 295S" . . . 300S" and a terminal (a) in parallel relation.

Figure 31:
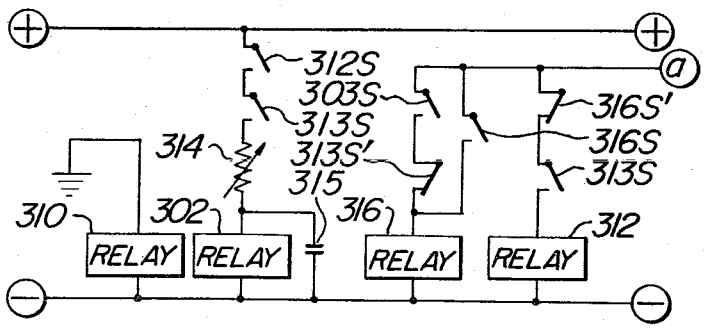
FIG. 31 is a safety means operating circuit diagram.

FIG. 31 shows a circuit to further ensure the safety of the shiftable stack units. Reference numeral 310 designates a ground relay which is actuated when the plus side of the control circuit is grounded to the stack body, to sound a warning buzzer 311 in FIG. 35, and its minus side is connected to the (−) terminal. The locking delay relay 302 by which the aisle locking relays 295 . . . 300 are held against actuation before the shiftable stack units begin to shift upon selection of the aisle, is connected between the (+) and (−) terminals through the make contact 312S of a start instructing relay 312, the make contact 313S of a safety bar operation detecting relay 313 in FIG. 34 and a variable resistor 314 which sets the delay time of the locking delay relay 302, and a capacitor 315 is connected between the junction of the variable resistor 314 and the relay 302, and the (−) terminal, by which the time limit of said relay is set. The start instructing relay 312 serves to start the selection of shiftable stack units upon verifying the normal condition of the safety device and is connected between the (a) and (−) terminals through the break contact 316S' of a safety device operation memorizing relay 316 and the make contact 313S of the safety device operation detecting relay 313. The safety device operation memorizing relay 316 memorizes the fact that the safety device is operated during shifting of the shiftable stack units and is connected between the (a) and (−) terminals through the make contact 303S of the shift detecting relay 303 and the break contact 313S' of the safety bar operation detecting relay 313. The make contact 316S of the safety device operation memorizing relay 316 is connected in parallel to the make contact 303S and the break contact 313S'.

Figure 32:
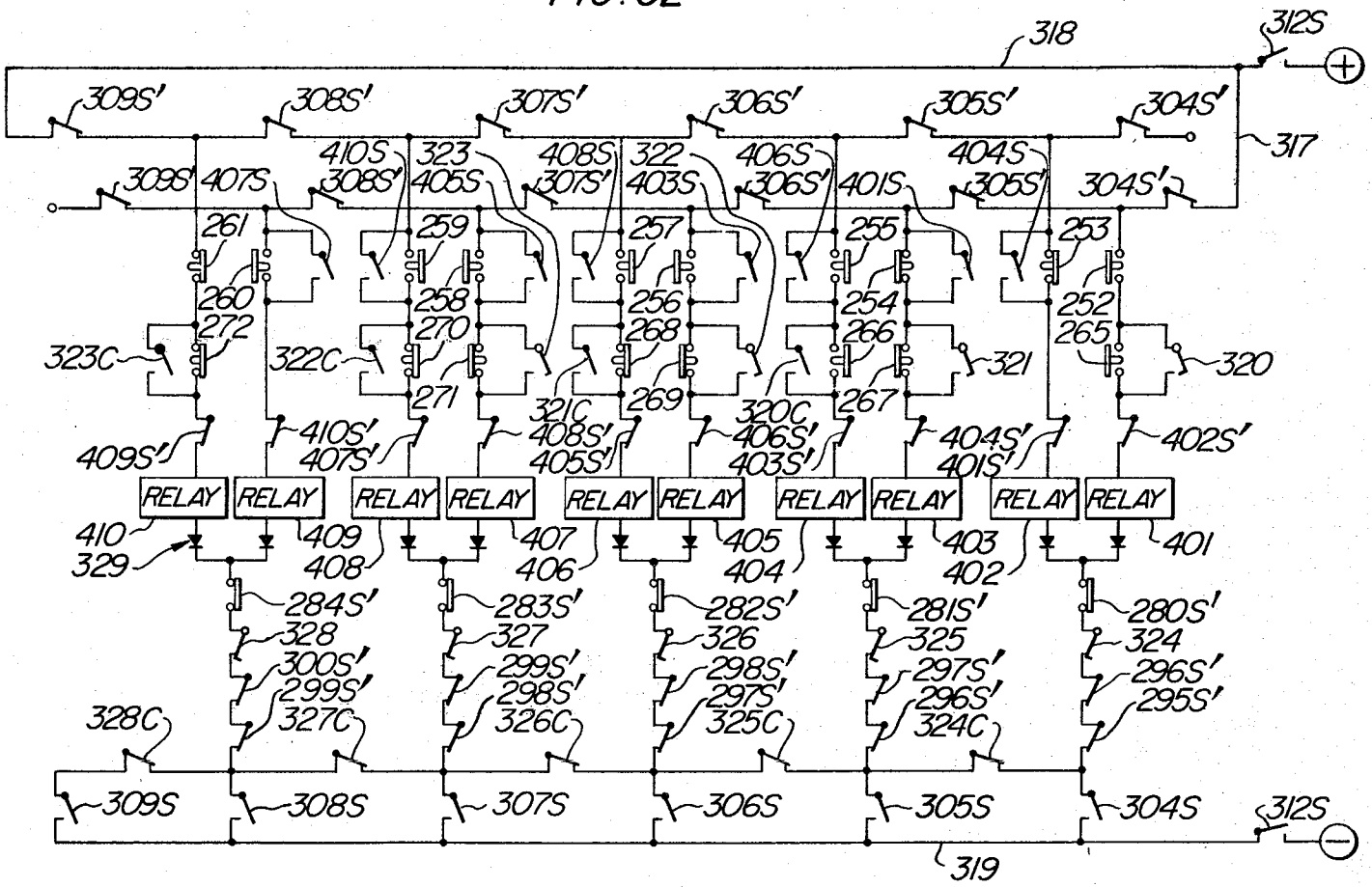
FIG. 32 is a shiftable stack unit selecting circuit diagram.

FIG. 32 shows a shiftable stack unit selecting circuit and a conductor 317 branched from the (+) terminal through the make contact 312S of the start instructing relay 312 has the break contacts 304S' . . . 309S' of the aisle selection signal receiving relays 304 . . . 309 connected in series thereto. Another branched conductor 318 similarly has the break contacts 309S' . . . 304S' connected in series thereto. Between a point of the conductor 317 intermediary of the break contacts 304S' and 305S', and a conductor 319 connected to the (−) terminal through the make contact 312S of the start instructing relay 312, is connected the electromagnetic switch auxiliary relay 401 for the motor for rightward shifting of the shiftable stack unit 203 through the limit switch 252, a parallel circuit of the aisle width control switch 265 and a switch 320 to short-circuiting said switch 265, and the break contact 402S' of the electromagnetic switch auxiliary relay 402 for leftward shifting, and through reverse-current preventing diode 329, the break contact 280S' of the thermal relay 280, a toggle switch 324 for bringing the shiftable stack unit 203 into a stationary state, the break contact 296S' of the aisle locking relay 296, the break contact 295S' of the aisle locking relay 295 and the make contact 304S of the aisle selection signal receiving relay 304. Between the junction of the reverse-current preventing diode 329 and the break contact 280S', and a point of the conductor 318 intermediary of the break contacts 305S' and 304S', is connected the electromagnetic switch auxiliary relay 402 for the motor for leftward shifting of the shiftable stack unit 203 through a parallel circuit of the limit switch 253 and the make contact 404 of the electromagnetic switch auxiliary relay 404S, the break contact 401S' of the electromagnetic switch auxiliary relay 401 and the reverse-current preventing diode 329. An electromagnetic switch auxiliary relay 403 for the motor for rightward shifting of the shiftable stack unit 204 is connected between a point of the conductor 317 intermediary of the break contacts 305S' and 306S', and the conductor 319 through a parallel circuit of the limit switch 254 and the make contact 401S of the electromagnetic switch auxiliary relay 401, a parallel circuit of the aisle width control switch 267 and a switch 321 for short-circuiting said switch 267, and the break contact 404S' of an electromagnetic switch auxiliary relay 404 for leftward shifting, and further through the diode 329, the break contact 281S' of the thermal relay 281, a toggle switch 325 for bringing the shiftable stack unit 204 into a stationary state, the break contact 297S' of the aisle locking relay 297, the break contact 296S' of the aisle locking relay 296 and the make contact 305S of the aisle selection signal receiving relay 305. The electromagnetic switch auxiliary relay 404 is connected between the point of the conductor 318 intermediary of the break contacts 306S' and 305S' and the junction of the diode 329 and the break contact 281S', through a parallel circuit of the limit switch 255 and the make contact 406S, a parallel circuit of the aisle width control switch 266 and the contact 310C of the switch 320 for short-circuit said switch 266, and the break contact 403S' of the electromagnetic switch auxiliary relay 403. Electromagnetic switch auxiliary relays 405 . . . 408 for rightward and leftward shifting of the shiftable stack units 205 and 206 also respectively include short-circuit switches 322 and 323, contacts 321C and 322C operatively connected to the short-circuit switches 321 and 322 and toggle switches 326 and 327, and are connected in like manner to the electromagnetic switch auxiliary relays for rightward and leftward shifting of the shiftable stack unit 204. Electromagnetic switch auxiliary relay 409 for rightward shifting of the shiftable stack unit 207 is connected through a parallel circuit of the limit switch 260 and the make contact 407S of the electromagnetic switch auxiliary relay 407, and the break contact 410S' of an electromagnetic switch auxiliary relay 410 on one side, and through the diode 329, the break contact 284S' of the thermal relay 284, a toggle switch 328 for bringing the shiftable stack unit into a stationary state, the break contact 300S' of the aisle locking relay 300, the break contact 299S' of the aisle locking relay 299 and the make contact 308S of an aisle selection signal receiving relay 308. The electromagnetic switch auxiliary relay 410 for leftward shifting is connected between a point of the conductor 318 intermediary of the break contacts 309S' and 308S', and the junction of the diode 329 and the break contact 284S' of the thermal relay 284, through a parallel circuit of an aisle width control switch 272 and the contact 323C of a switch 323 for short-circuit said switch 272, and the break contact 409S' of the electromagnetic switch auxiliary relay 409. Further, between the junction of the break contact 295S' and the break contact 304S, and the junction of the break contact 296S' and the make contact 305S, is connected a contact 324C which is operatively connected to the toggle switch 324, and between the junction of the break contact 296S' and the make contact 305S, and the junction of the break contact 297S' and the make contact 306S, is connected a contact 325C which is operatively connected to the toggle switch 325. Similarly, a contact 326C operatively connected to the toggle switch 326 is connected between the junction of the break contact 297S' and the make contact 307S, and the junction of the break contact 298S' and the make contact 307S, and a contact 327C operatively connected to the toggle switch 327 is connected between the junction of the break contact 298S' and the make contact 307S, and the junction of the break contact 299S' and the make contact 308S. Between the junction of the break contact 299S' and the make contact 308S, and the junction of the make contact 308S and the conductor 319, is connected the make contact 309S of an aisle selection signal receiving relay 309. The short-circuit switches 320 . . . 323 and the toggle switches 324 . . . 328 are provided in the control boards 210 . . . 214 of the respective shiftable stack units.

Figure 33:
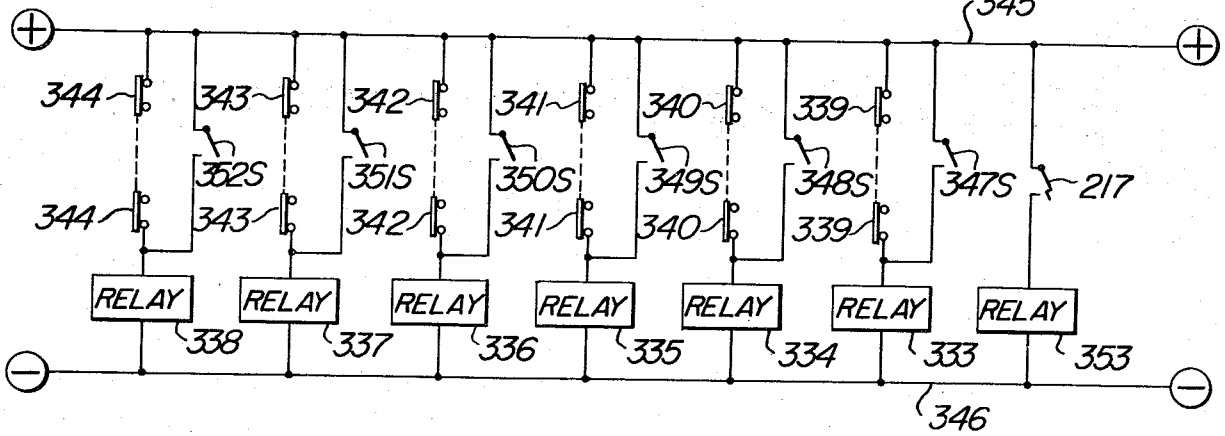
FIG. 33 is a circuit diagram of a safety bar operating circuit for the shiftable stack unit.

FIG. 33 shows an operating circuit for the safety bar provided on each shiftable stack unit. Safety bar operation signal receiving relays 333 . . . 338 which receive a signal indicative of the fact that the safety bar 237 has been pushed by an obstacle, are connected in parallel between a conductor 345 connected to the (+) terminal and a conductor 346 connected to the (−) terminal, through safety bar switches 339 . . . 344 which are actuated when a plurality of the safety bars provided facing the aisle are pushed. Connected in parallel to these switches are the make contacts 347S . . . 352S of illuminating lamp lighting relays 347 . . . 352 shown in FIG. 38. Also connected between the conductors 345 and 346 are the special operation switch 217 of the shiftable stack units shown in FIG. 18 and a special operation relay 353 for receiving a signal indicative of the operation of said switch 217. This special operation switch 217 is a key switch by which the safety bar operation detecting circuit is temporarily short-circuited when the safety bar circuit fails, to enable the stack shifting operation to be performed.

Figure 34:
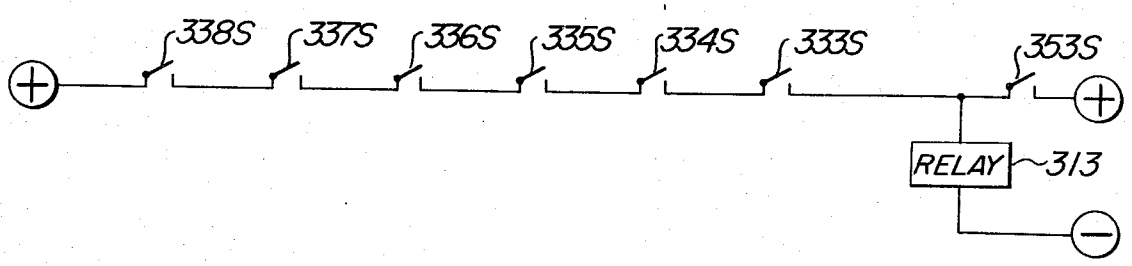
FIG. 34 is a safety bar operation detecting circuit diagram.

FIG. 34 shows a circuit for detecting the operation of the safety bars. A safety bar operation detecting relay 313 is connected between the (+) and (−) terminals through a series circuit of the make contacts 333S . . . 338S of the safety bar operation signal receiving relays 333 . . . 338, and the make contact 353S of the special operation relay 353 is connected in parallel to said circuit.

Figure 35:
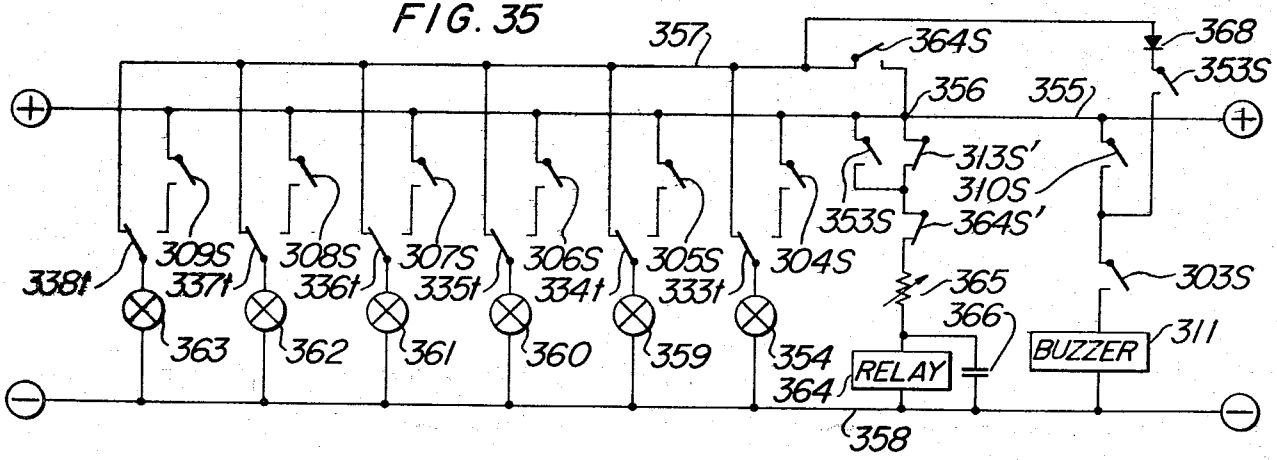
FIG. 35 is an aisle indicating lamp and warning circuit diagram.

FIG. 35 shows a circuit for lighting the aisle indicating lamps provided in the aisle switches on the control boards 210 . . . 214 of the respective shiftable stack units 203 . . . 207 and for indicating the operation of the safety device. In the aisle indicating lamp lighting circuit, the aisle indicating lamp 354 to indicate that the aisle A is open, is connected on its plus side to a conductor 355 connected to the (+) terminal, through the make contact 304 of the aisle selection signal receiving relay 304, and to a conductor 357 branched from said conductor 355 at a point 356, through the transfer contact 333t of the safety bar operation signal receiving relay 333, and the negative side thereof is connected to a conductor 358 connected to the (−) terminal. The aisle indicating lamps 359 . . . 363 for the aisle B to F are similarly connected on their plus side of the conductors 355 and 357 through the make contacts 305S . . . 309S of the aisle selection signal receiving relays 305 . . . 309 and transfer contacts 334t . . . 338t of the safety bar operation signal receiving relays 334 . . . 338 and on the minus side to the conductor 358, respectively. Between the conductor 357 and the branch point 356 is connected the make contact 364S of a flicker relay 364.

A warning and safety device operation indicating circuit is provided for flashing the aisle indicating lamp of a specific shiftable stack unit or sounding an alarm during when the safety bar is actuated or during the special operation. The flicker relay 364 is a relay to flicker the indicating lamp and the warning buzzer when the safety bar is in an actuated position and when the special operation is performed, and is connected between the branch point 356 and the conductor 358 with the break contact 313S' of the safety bar operation detecting relay 313, the break contact 364S' of the flicker relay 364 and the variable resistor 365 interposed between it and said branch point 356, said variable resistor 365 adjusting the rate of flicker. The make contact of the special operation relay 353 is connected in parallel to the break contact 313S' of the safety bar operation detecting relay 313, and a capacitor 366 is connected in parallel to the flicker relay 364 to provide intermittent flicker. A warning buzzer 311 to sound an alarm at the time of special operation or grounding is connected between the conductors 357 and 358 through a reverse-current preventing diode 368, the make contact 353S of the special operation relay 353 and the make contact 303S of the shift detecting relay 303. Between the junction of the make contacts 353S and 303S of this buzzer circuit and the conductor 355 is connected the make contact 310S of the grounding relay 310.

FIG. 36 is a circuit to detect the shifting of the shiftable stack units. Between the (+) terminal and a conductor 367 connected to the (−) terminal through the shift detecting relay 303 is connected the make contact 304S of the aisle selection signal receiving relay 304 through the make contact 402S of the electromagnetic switch auxiliary relay 402 for the motor for leftward shifting of the shiftable stack unit 203. The make contact 305S of the aisle selection signal receiving relay 305 is connected between the (+) terminal and the conductor 367 through a parallel circuit of the make contact 401S of the electromagnetic switch auxiliary relay 401 for rightward shifting of the shiftable stack unit 203 and the make contact 404S of the electromagnetic switch auxiliary relay 404 for leftward shifting of the shiftable stack unit 204, and the make contact 306S of the aisle selection signal receiving relay 306 is connected between the (+) terminal and the conductor 367 through a parallel circuit of the make contact 403S of the electromagnetic switch auxiliary relay 403 for rightward shifting of the shiftable stack unit 204 and the make contact 406S of the electromagnetic switch auxiliary relay 406 for leftward shifting of the shiftable stack unit 205. Similarly, the make contacts 307S and 308S of the aisle selection signal receiving relays 307 and 308 are connected in parallel between the (+) terminal and the conductor 367 through a parallel circuit of the make contacts 405S and 408S and a parallel circuit of the make contacts 407S and 410S respectively, and the make contact 309S of the aisle selection signal receiving relay 309 through the make contact 409S.

Figure 37:
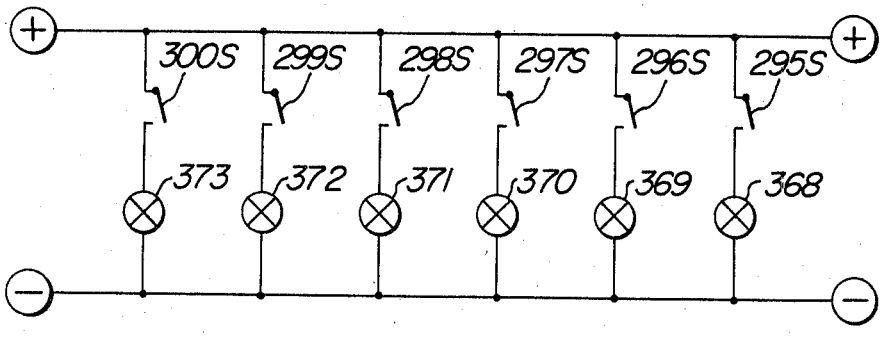
FIG. 37 is a circuit diagram of aisle locking indicating lamps to indicate the formation of an aisle.

FIG. 37 is an indicating lamp circuit to indicate the locking of a specific aisle, which includes aisle locking indicating lamps 368 . . . 373 by which it is indicated at the point when the selected aisle has been formed and shifting of the shiftable stack units has been completed, the fact that the shiftable stack units on both sides of the aisle are locked and the control circuit is restored. These lamps are connected between the (+) and (−) terminals through the make contacts 295S . . . 300S of the aisle locking relays 295 . . . 300 respectively.

Figure 38:
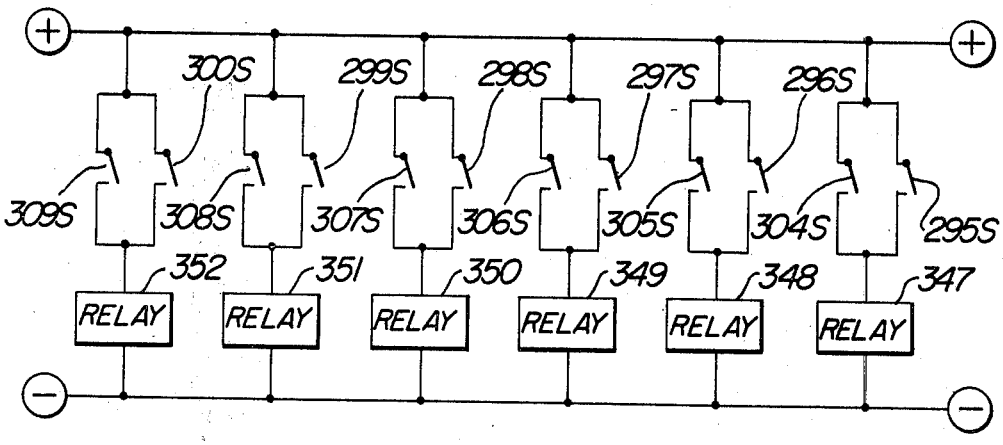
FIG. 38 is a circuit diagram of a circuit for operating an illumination lamp provided on the top of each shiftable stack unit.

FIG. 38 shows an illuminating lamp lighting relay. The illuminating lamp lighting relays 347 . . . 353 to light the illuminating lamps are connected between the (+) and (−) terminals through parallel circuits of the make contacts 295S . . . 300S of the aisle locking relays 295 . . . 300 and the make contacts 304S . . . 309S of the aisle selection signal receiving relays 304 . . . 309, respectively.

Figure 39:
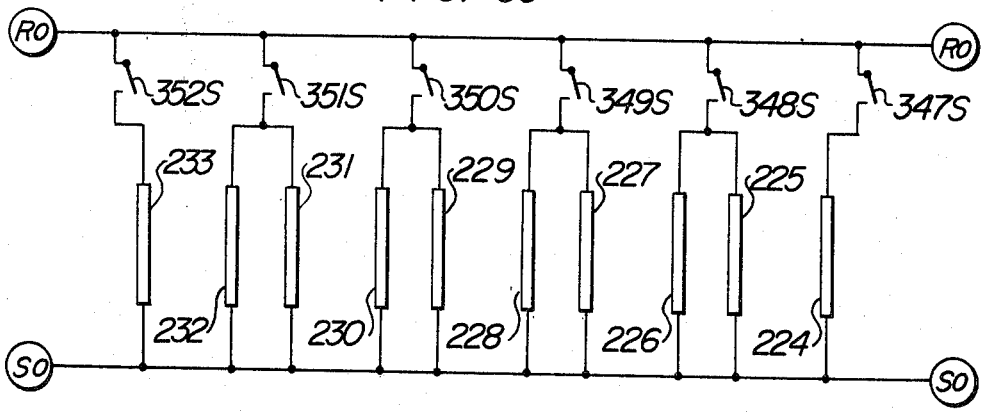
FIG. 39 is a circuit diagram of the illumination lamps.

FIG. 39 shows an illuminating circuit including the illuminating lamps 224 . . . 233 provided on the respective shiftable stack units. The illuminating lamps 224 and 233 for illuminating the aisles A and F are connected in parallel between the (+) and (−) terminals through the make contacts 347S and 352S of the illuminating lamp lighting relays 347 and 352 respectively, and the lamps for illuminating the other aisles, provided on the respective shiftable stack units, are connected in parallel between the (+) and (−) terminals through the make contacts 348S . . . 351S of the illuminating lamp lighting relays 348 . . . 351 for the respective stack units.

The operation of the second embodiment of the invention constructed as described above will be explained hereunder: First of all, the normal operation of the device for forming an aisle between the desired shiftable stack units by operating the aisle switches 218 . . . 223 for the respective shiftable stack units will be explained. Although FIG. 18 shows the state wherein the aisles B and F are formed, it is assumed that the shiftable stack units 204 . . . 207 are put together on the right side of FIG. 18, and the operation will be described with reference first to the case wherein the aisle switch 219 is switched on for the formation of the aisle B as shown in FIG. 18.

The power source switch 216 is switched on at first, whereupon a single-phase A.C. voltage is impressed across the terminals R0 and S0. The electromagnetic switch 277 for starting the motor is actuated and its make contact 277S is closed, whereby a three-phase A.C. voltage is applied to the terminals R1, S1 and T1. On the other hand, the voltage transformed by the transformer 275 is applied to the rectifier 273 and the D.C. voltage rectified by said rectifier appears across the (+) and (−) terminals. The power source lamp 278 is lit to illuminate the power source switch 216 portion of the control board 210, whereby the operator becomes aware of the fact that the device is connected to the power source.

In FIG. 33, the D.C. voltage appears across the (+) and (−) terminals and the safety bar switches 339 . . . 344 are all switched on, if the safety bars 237 in the respective aisles are in the normal condition. Thus, all of the safety bar operation signal receiving relays 333 . . . 338 are actuated. Therefore, the make contacts 333S . . . 338S of these relays shown in FIG. 34 are closed and the operating circuit for the safety bar operation detecting relay 313 is closed, with the result that the relay 313 is actuated. The transfer contacts 333t . . . 338t of the safety bar operation signal receiving relays 333 . . . 338 are switched to the opposite side in FIG. 35.

In the aisle selecting circuit of FIG. 30, when the aisle switch 219 is switched on to form the aisle B, the operating circuit for the aisle selection signal receiving relay 305, extending from the (+) terminal through the aisle switch 219 and the break contact of the make-before-break contact 296S″ to the (−) terminal, is closed so that the relay 305 is actuated and its make contact 305S is closed, and further a plus voltage is impressed on the terminal (a). By the plus voltage developed at the terminal (a), the operating circuit for the start instructing relay 312 in FIG. 31 is closed through the break contact 316S′ and the make contact 313S, and the relay 312 is actuated. In the aisle indicating lamp circuit of FIG. 35, on the other hand, since the make contact 305S is closed, the aisle indicating lamp 359 is lighted and the aisle switch 219 portion of the control board 210 is illuminated, whereby the selection of the aisle is confirmed. In the circuits of FIGS. 32 and 36, the make contact 305S is closed, and in the circuit of FIG. 38 the make contact 305S is closed. Therefore, the operating circuit for the illuminating lamp lighting relay 348 is closed actuating the relay 348 and closing the make contact 348S in FIG. 39. Thus, the illuminating lamps 225 and 226 are lit.

In the shiftable stack unit selecting circuit of FIG. 32, the positions of the limit switches 252 . . . 261 correspond to the positions of the shiftable stack units shown in FIG. 18. In the case wherein all of the shiftable stack units are put together on the right side of FIG. 18 as stated above, the limit switch 261 only is closed and all of the remaining limit switches 252 . . . 260 are held opened. Further, in the circuit of FIG. 32, all of the short-circuit switches 320 . . . 323 are held opened; all of the aisle width control switches 265 . . . 272 are held closed; and all of the toggle switches 324 . . . 328 to switch the shiftable stack units into the stationary state are also held closed. When the break contact 305S′ is opened and the make contact 312S of the start instructing relay 312 is closed by the operation of the aisle selecting signal receiving relay 305 in this state, the electromagnetic switch auxiliary relays 401, 404, 406, 408 and 410 for motors are submitted for selection. In this case, the electromagnetic auxiliary relay 401 for rightward shifting is not actuated because the limit switch 252 is open, and the electromagnetic auxiliary relays 404, 406 and 408 for leftward shifting are not actuated either because the limit switches 255, 257 and 259 and the make contacts 406S, 408S and 410S of said relays connected in parallel to said limit switches, are open, but the electromagnetic switch auxiliary relay 410 for leftward shifting is actuated, with the result that the make contact 410S is closed and the break contact 410S′ is opened. Therefore, the make contact 410S connected in parallel to the limit switch 259 is closed, to actuate the electromagnetic switch auxiliary relay 408 for leftward shifting. As a result, the limit switch 257 connected in parallel to the limit switch 257 is closed to actuate the electromagnetic switch auxiliary relay 406 for leftward shifting. Similarly, the electromagnetic switch auxiliary relay 404 for leftward shifting is actuated, and the electromagnetic switch auxiliary relays 410, 408, 406 and 404 for leftward shifting complete their operations sequentially. In the shift detecting circuit of FIG. 36, the make contacts 410S, 408S, 406S and 404S of these electromagnetic switch auxiliary relays are closed but the operating circuit for the shift detecting relay 303 includes only the make contacts 401S and 404S connected in parallel to the make contact 305S of the aisle selection signal receiving relay 305, which is held closed upon actuation of said relay, and is not sensitive to the other make contacts 410S, 408S and 406S. Therefore, the shift detecting relay 303 is operated by the make contact 404S.

On the other hand, in the electromagnetic switch circuit of FIG. 29 the electromagnetic switches 294, 292, 290 and 288 for leftward shifting are actuated due to closure of the make contacts 410S, 408S, 406S and 404S. In the motor circuit of FIG. 28 the three-phase A.C. voltage is impressed on the motors 241M5 . . . 241M2 from the terminals R1, S1 and T1 upon closure of the make contacts 294S, 202S, 290S and 288S, to rotate said motors in the normal direction. Therefore, the shiftable stack units 207, 206, 205 and 204 start to shift to the left. The shiftable stack unit 203 only is not shifted because the break contact 305S' is open and hence the electromagnetic switch auxiliary relay circuit for leftward shifting is not selected. Further, the circuit for rightward shifting is not operated, even if selected, because the limit switch 252 is open. The motor 241M2 on the shiftable stack unit 204 only is stopped by the aisle width control device shown in FIG. 25, at the point when the aisle width control switch 266 is actuated, because upon actuation of said switch 266, the operating circuit for the electromagnetic switch auxiliary relay 404 for leftward shifting is broken to restore the auxiliary relay 404 and also to restore the electromagnetic switch 288. Namely, the shiftable stack unit does not move up to the end of its stroke but stops at the point where the aisle width control switch 266 is actuated. As for the other shiftable stack units, the make contact 404S shown in FIG. 36 is opened incident to restoration of the electromagnetic switch auxiliary relay 404, independently of the aisle width control switch, and the shift detecting relay 303 is restored, whereby the aisle locking relay 296 to be described later is actuated to restore the aisle selection signal receiving relay 305 which has been actuated for the formation of the aisle B, and the respective shiftable stack units are brought into a halt irrespectively of the limit switches. Thus, it will be understood that when the aisle B is selected in the state wherein all shiftable stack units are put together on the right side of FIG. 18, the respective shiftable stack units are placed in the positions shown in FIG. 18 and the aisle B is formed.

In the circuit of FIG. 31, the locking delay relay 302 is actuated with a certain time delay from the point when the aisle is selected, by the effects of the resistor 314 and the capacitor 315, because upon selection of the aisle, the start instructing relay 312 is actuated and its make contact 312S is closed, and the make contact 313S is also held closed. The relay 302 closes its make contact 302S in the aisle selecting circuit of FIG. 30, but the shiftable stack units start shifting from the point when the aisle is selected, and the shift detecting relay 303 is actuated, with its break contact 303S' opened. When the shiftable stack units on both sides of the selected aisle have completed their shifting, the shift detecting relay 303 in FIG. 36 is restored and the break contact 303S' in FIG. 30 is closed. Therefore, in FIG. 30 the aisle locking relay 296 is actuated from the (+) terminal through the make contact 302S, the break contact 303S' and the make contact 305S of the aisle selection signal receiving relay 305. As a result, the make contact side of the make-before-break contact 296'' is closed and the break contact side thereof is opened and self-held. At the same time, the aisle selection signal receiving relay 305 is restored which has been actuated by the aisle switch 219. By the restoration of the relay, the circuit is returned to the original state and all of the shifting stack units are brought to a halt. Further, the aisle locking relay 296 is actuated to light the aisle locking indicating lamp 369 shown in FIG. 37. In FIG. 38, the make contact 296S is closed to continuously hold the illuminating lamp lighting relay 348 in the actuated position, which has been actuated by the make contact 305S. Thus, the make contact 348S in FIG. 39 is continuously held in the operated position and the illuminating lamp is lit continuously.

In the shiftable stack unit selecting circuit of FIG. 32, the break contact 296S' of the aisle locking relay 296 is opened incident to actuation of said relay 296 and, therefore, the operating circuits for the electromagnetic auxiliary relays 401 . . . 404 for shifting the shiftable stack units 203 and 204 are not closed. Thus, the shiftable stack units 203 and 204 are held immovable no matter what instructions are given to the aisle.

When the aisle switch 221 on the control board 212 of the shiftable stack unit 205 is switched on in this state, to select the aisle D, the aisle selection signal receiving relay 307 in FIG. 30 is actuated and its make contact 307S is closed, so that the start instructing relay 312 in FIG. 31 is again actuated. On the other hand, the make contact 307S in FIG. 35 is also closed to light the aisle indicating lamp 361. The illuminating lamp lighting relay 350 in FIG. 38 is also actuated and the illuminating lamps 229 and 230 in FIG. 39 are lit.

In FIG. 32, the break contact 307S' of the aisle selection signal receiving relay 307 is opened incident to actuation of said relay, so that the circuit for rightward shifting is selected for the shiftable stack units 203, 204 and 205 and the circuit for leftward shifting is selected for the shiftable stack units 206 and 207. However, the shiftable stack units 203 and 204 will not be operated even if they are selected, because the break contact 296S' of the aisle locking relay 296 in the operating circuits for these stack units is open. The shiftable stack unit 205 will not be operated either because it is in contact with the adjacent shiftable stack unit 204, and the limit switch 256 and the make contact 403S are open. Consequently, the shiftable stack unit 207 only can actuate the electromagnetic switch auxiliary relay 410 for leftward shifting through the limit switch 261. In other words, the operating circuit extending from the (+) terminal to the (−) terminal through the make contact 312S, the conductor 318 and the break contact 309S' of the aisle selection signal receiving relay 309, and further through the limit switch 261, the aisle width control switch 272, the break contact 409S', the electromagnetic switch auxiliary relay 410 for leftward shifting, the reverse-current preventing diode 329, the break contact 284S' of the thermal relay 284, the toggle switch 328, the break contacts 300S' and 299S', the make contact 307S of the aisle selection signal receiving relay 307 actuated for the formation of the aisle D, the conductor 319 and the make contact 312S, whereby the electromagnetic switch auxiliary relay 410 is actuated. As a result, the make contact 410S of the relay 410, which is connected in parallel to the limit switch 259 in the operating circuit for the electromagnetic switch auxiliary relay 408 for the leftward shifting of the shiftable stack unit 206, is closed and said relay 408 is also actuated. In FIG. 36, the shift detecting relay 303 is actuated incident to closure of the make contact 408S of the electromagnetic switch auxiliary relay 408 for leftward shifting. In the electromagnetic switch circuit of FIG. 29, the electromagnetic switches 294 and 292 are actuated upon closure of the make contacts 410S and 408S. In the motor circuit of FIG. 28, the motors 241M5 and 241M4 are driven in the normal direction upon closure of the make contacts 294S and 292S, to shift the shitable stack units 207 and 206 to the left. The shiftable stack units 207 and 206 continue to move until they reach the end of their leftward strokes to open the limit switch 261. When the limit switch 261 is opened, the electromagnetic switch auxiliary relay 410 for leftward shifting is restored and hence the motor 241M5 stops rotating. Since the shiftable stack units 206 and 207 are shifted while being held in contact with each other, the limit switch 259 is held open. When the electromagnetic switch auxiliary relay 410 for shifting the shiftable stack unit 207 to the left is restored, the make contact 410S connected in parallel to the limit switch 259 is opened, whereby the electromagnetic switch for leftward shifting is restored and the motor 241M4 is brought to a halt. In this case, the aisle width control switch 270 of the shiftable stack unit 206 is also actuated almost concurrently. The aisle locking relay 298 in FIG. 30 is actuated at this point. Upon actuation of the relay 298, the operating circuit for the aisle selecting signal receiving relay 307 is opened similar to the preceding case and the start instructing relay 312 in FIG. 31 is restored. Thus, the circuit is brought into the state wherein no aisles are selected. Upon actuation of the aisle locking relay 298, its make contact 298S is closed and the aisle locking indicating lamp 371 is lit. The make contact 298S in FIG. 38 is also closed, whereby the illuminating lamp lighting relay 350 is continuously held actuated, with the illuminating lamps 229 and 230 being continuously lit. On the other hand, the actuation of the aisle locking relay 298 results in opening of its break contact 298S' in FIG. 32, so that the operating circuits for the shiftable stack units 205 and 206 on both sides of the aisle D are opened and brought into a locked state.

As described above, the circuit is continuously held in the selected state from the time when the aisle is selected to the time when the shiftable stack units on both sides of the selected aisle are brought to a halt. The shiftable stack units on both sides of the aisle are automatically locked when brought to a halt, and the control circuit is restored, providing for the selection of the next aisle. However, when the shiftable stack units are arranged to form two aisle as in the present embodiment, an additional aisle cannot be formed because the embodiment is not designed to form more than two aisles concurrently.

When the aisle switch 219 is switched off upon completion of the storage work through the aisle B, the aisle A or C can be selected. For selecting the aisle C, the aisle switch 220 is switched on, whereupon the aisle selection signal receiving relay 306 in the aisle selecting circuit of FIG. 30 is actuated, similar to the preceding case, and its make contact 306S is closed. The start instruction relay 312 in FIG. 31 is actuated and the aisle indicating lamp 360 in FIG. 35 is lit. Further, the illuminating lamp lighting relay 349 in FIG. 38 is actuated to light the illuminating lamps 227 and 228 in FIG. 39. On the other hand, in FIG. 32 the break contact 306S' of the aisle selection signal receiving relay 306 is opened incident to actuation of said relay and the operating circuit for leftward shifting is selected for the shiftable stack units 207, 206 and 205 and the operating circuit for rightward shifting for the shiftable stack units 203 and 204. However, the shiftable stack units 205 and 206 are immovable because the break contact 298S' of the aisle locking relay 298 is open, and the shiftable stack unit 207 is also immovable because the limit switch 261 is open. Similarly, the shiftable stack unit 203 is immovable. Consequently, the shiftable stack unit 204 only is shifted to the right upon actuation of the electromagnetic switch auxiliary relay 403 for rightward shifting, because the limit switch 254 is closed. The shiftable stack unit 204 moves until the limit switch 254 is brought into abutment against and opened by the shiftable stack unit 203. When the limit switch 254 is opened, the aisle locking relay 297 is actuated, whereby the shiftable stack units 204 and 205 are locked in their positions and the control circuit is restored, similar to the preceding case.

The aisle switches 220 and 221 are in their ON-position at this point, so that the aisle locking relays 297 and 298 are actuated and the illuminating lamps 227, 228, 229 and 230 for the aisles C and D are lit up. When these aisle switches 220 and 221 are switched off, the aisle locking relays 297 and 298 are restored and the aisle illuminating lamps are turned off. Thereafter, two different aisles can be newly selected.

When the aisle A or F is selected at the point when all circuits are restored, all of the shiftable stack units are put together on either the right or left side and a space equivalent to two aisles is formed.

Where it is desired to form a wide aisle of a width equivalent to the width of two aisles between the selected two adjacent shiftable stack units, this can be achieved by the following operation:

Namely, if the function of the aisle width control device is released as shown in FIG. 26, the aisle can be expanded to the full length of the stretched arm. Such a wide aisle can be formed by switching the short-circuit switches 320 . . . 323 in FIG. 32 on. Namely, even when the aisle width control switches 265 . . . 272 are actuated and switched off, the electromagnetic switch auxiliary relay circuits are formed by the short-circuit switches, independently of said width control switches, and are controlled only by the limit switches 252 . . . 261.

As described above, even if the aisle B is selected in the state wherein all of the shiftable stack units are put together on the right side of the article storage device, the state of FIGS. 18 and 19 cannot be obtained but a wide aisle equivalent to two aisles is formed at the location of the aisle B, and the movement of the respective stack units is stopped by the respective limit switches.

Next, reference will be made to the case when the safety bar is actuated during the above-described normal operation.

Suppose that an obstacle is present in the aisle F when the aisle B is selected in the state wherein all of the shiftable stack units are put together on the right side of the storage device, as stated above. Upon actuating the aisle switch 219 in FIG. 30, the shiftable stack units 207, 206, 205 and 204 begin to move to the left. When the safety bar 237 projecting into the aisle F is pushed by the obstacle during the movement, either one of the safety bar switches 344 is actuated and the safety bar operation signal receiving relay 333 is restored. The make contact 338S in FIG. 34 is opened and the safety bar operation detecting relay 313 is restored. The make contact 313S in FIG. 31 is opened and the start instructing relay 312 is restored, so that the break contact 313S' in the operating circuit for the safety device operation memorizing relay 316 is closed. The relay 316 is actuated and self-held by its contact 316S. The relay 316 opens its break contact 316S' in the operating circuit for the start instructing relay 312, so that the start instructing relay 312 cannot be actuated until the safety device operation memorizing relay 316 is restored. Then, the make contact 312S in FIG. 32 is opened and the operating circuits for the electromagnetic switch auxiliary relays for motors are all opened. As a result, these electromagnetic switch auxiliary relays are all restored to restore the electromagnetic switches in FIG. 29, and thus all of the motors are stopped. On the other hand, when the safety bar 237 in the aisle F is held in the actuated position, the safety bar operation signal receiving relay 338 in FIG. 33 is held in its restored position and the safety bar operation detecting relay 313 in FIG. 34 is also held in the restored position. Therefore, the transfer contact 338t in FIG. 35 is switched to the position shown and the break contact 313S' in the operating circuit for the flicker relay 364 is closed to form said operating circuit. The flicker relay 364 has in its operating circuit the variable resistor 365 and the capacitor 366 connected in parallel thereto. Therefore, the flicker relay 364 is not actuated immediately after the operating circuit is closed, but is actuated with a certain time delay. When the flicker relay 364 is actuated, it opens its own break contact 364S' and is held in the actuated position for a predetermined period of time by the discharge current of the capacitor 366. Upon completion of discharge of the capacitor 366, the flicker relay 364 is again restored, whereby its break contact 364S' is closed and its operating circuit is closed. Thus, the flicker relay 364 is actuated for a predetermined period of time and restored for a predetermined period of time repeatedly, with its contact closed and opened repeatedly. The aisle indicating lamp 363 is flashed incident to the operation of the make contact 364S of the flicker relay 364, indicating that the safety device is actuated in the aisle F. On the other hand, the locking delay relay 302 in FIG. 31 is not actuated since the make contact 312S in the operating circuit thereof is open. The make contact 302S in the operating circuit for the aisle locking relay will be held opened even if the aisle selection signal receiving relay 305 in FIG. 30 is actuated, and the aisle locking relay 296 will not be actuated even if the shift detecting relay 303 in FIG. 36 is restored. Therefore, the aisle locking indicating lamps in FIG. 37 are not lit and the aisle selection signal receiving relay 305 is not restored. Thus, the aisle indicating lamp 359 in FIG. 35 is kept on.

Such a difference in the on-off state of the lamps is indicative of the difference from the case wherein the shiftable stack units are shifted and stopped in the normal condition. When the safety bar 237 is actuated only momentarily, the safety bar operation signal receiving relay is restored only momentarily and the other operation of the control circuit is the same as described above, except that the aisle indicating lamp to indicate the operation of the safety device is not flashed.

After removing the obstacle, the aisle switch 219 is switched off once and then switched on again, whereby it is possible to shift the shiftable stack units in the same manner as in the preceding case.

For the special operation, the special operation switch 217 is switched on similar to the first embodiment described previously, whereupon the special operation relay 353 in FIG. 33 is actuated and its make contact 353S is closed. Therefore, the safety bar operation detecting relay 313 is actuated even when the make contacts 333S . . . 338S in FIG. 34 are open. By reason of this relay 313, the shiftable stack units can be shifted even with the safety device in operation. The buzzer 311 intermittently sounds an alarm due to the effect of the flicker relay 364, similar to the first embodiment, making it known to the operator that the function of the safety device has ceased.

When the thermal relays 280 . . . 284 similar to the thermal relays 91 . . . 95 in the first embodiment, are actuated, the break contacts 280S' . . . 284S' thereof in FIG. 32 are opened, whereby the circuits of the electromagnetic switch auxiliary relays of the shifting stack units are opened. In this case, the shiftable stack units of which thermal relays are actuated, are stopped and the following shiftable stack units are also stopped as the circuits of their electromagnetic switch auxiliary relays are opened. The preceding shiftable stack unit group is also brought to a halt because the aisle locking relay for the selected aisle is actuated to restore the aisle selection signal receiving relay. Obviously, the preceding shiftable stack unit group is not necessarily composed of a plurality of stack units. When the thermal relays are actuated, the circuit can be returned to the initial state by pushing restoring relays (not shown) for said respective thermal relays.

The grounding relay 310 is actuated in the same manner as in the first embodiment when a portion of the circuit is grounded to the main body, and causes the buzzer 311 to continuously sound an alarm.

The operation of the locking delay relay 302 in FIG. 31 will be further described hereunder. When the aisle switch 219, for example, is switched on in FIG. 30, the aisle selection signal receiving relay 305 is actuated, the make contact 305S on the aisle locking relay 296 is closed and the aisle is selected. There is some time delay from the point when the aisle selection signal receiving relay is actuated to the point when the electromagnetic switch auxiliary relay for motor is actuated. If the aisle locking relay 296 is actuated during this period, the aisle selection signal receiving relay 305 will be restored and the subsequent operation will not be obtained. In order to avoid this, an arrangement is made such that the locking delay relay 302 is actuated and its make contact 302S in the operating circuit for said aisle locking relay in FIG. 30 is closed with a certain time delay after the aisle is selected in FIG. 31 and the start instructing relay 312 is actuated. The break contact 303S' of the shift detecting relay 303 is opened and the aisle locking relay 296 is not actuated before the make contact 302S is closed. The time delay is so selected that the break contact 303S' is closed after the stack units on both sides of the selected aisle have been brought to a halt, and the aisle locking relay 296 is actuated at this point.

According to the second embodiment of the invention described above, the stack units selected to be shifted can start to move substantially concurrently irrespective of the on or off state of their limit switches, and therefore, the time required for the formation of a desired aisle can be shortened.

Further, where it is desired to form an aisle of a width necessary for the storage operation by the aisle width control device between the selected stack units, by previously providing in a unit group of shiftable stack units a space of a width equivalent to the width of a plurality of regular aisles, the preceding stack units are all stopped at the point when the stack units on both sides of the desired aisle are stopped, and therefore, unnecessary movement of the stack units can be avoided.

Still further, since the switch means are provided to stop the motors on the respective shiftable stack units individually temporarily, the shiftable stack units can be used in two groups, for instance, the shiftable stack units 202 . . . 205 as one group and the shiftable stack units 205 . . . 207 as another group, by opening the toggle switch 326 of the shiftable stack unit 205 in the state of FIG. 18, and in this case, the shiftable stack units in the left side group will not be shifted even when the right side group of the stack units is selected. It will be understood, therefore, that if the shiftable stack units are segregated into a plurality of groups and the stack units in each group are previously arranged with a space sufficient to form an aisle, it will be possible to shift only those stack units in a selected group which are required to be shifted to form a desired aisle, without unnecessarily shifting the other stack units.

The width of the aisle can be varied within a pre-set range by arranging the aisle width control device such that it is operable stepwise to define a plurality of different aisle widths. If there be no necessity to form an aisle of a width equal to the width of a plurality of the regular aisles at a location, a flexible rod material such as a chain may be used instread of the arm of the aisle width control device, to operate the width control switch by the tension of said rod material.

Although in the second embodiment described above, the storage device is provided with the limit switches which are operated when the adjacent shiftable stack units are brought into contact with or detached from each other, and the aisle width control devices by which the adjacent shiftable stack units are operatively connected with each other and the width of the aisle to be formed therebetween is controlled, such aisle width control devices are not necessarily required when the shiftable stack units are arranged with a space just enough to form one aisle.

The case when the limit switches only are provided in the second embodiment will be described hereunder with reference to the drawings of the second embodiment. In the following description, parts similar to those of the second embodiment are referred to by the same reference numerals. Namely, in the third embodiment of the invention, a shiftable stack unit the limit switch of which is placed in an ON-position, is shifted at first and the next adjacent shiftable stack unit is shifted when its limit switch is actuated by said first shiftable stack unit, and so on. Further, in the third embodiment, since there is provided a space just large enough to form one aisle, the aisles which can be formed are from A to E. In other words, the left side face of the shiftable stack unit 207 in FIG. 18 is in contact with the wall of the warehouse or the like.

Figure 24:
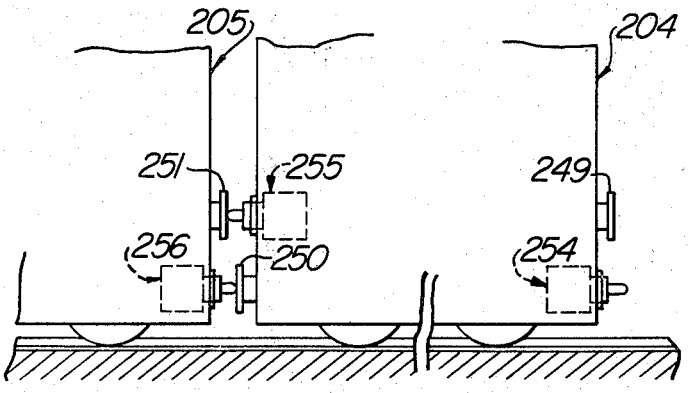
FIG. 24 is a view showing the details of the limit switch portion of the shiftable stack unit.

The shape and position of each limit switch are the same as in FIG. 24. The power source circuit of FIG. 27, the motor circuit of FIG. 28, the aisle selecting circuit of FIG. 30, the safety device operating circuit of FIG. 31, the safety bar operating circuit of FIG. 33, the safety bar operation detecting circuit of FIG. 34, the aisle lamp and warning circuit of FIG. 35, the aisle locking indicating lamp circuit of FIG. 37, the illuminating lamp lighting circuit of FIG. 38 and the illuminating lamp lighting circuit of FIG. 39 can be applied to the third embodiment as such and hence those circuits of the third embodiment are not shown. The shift detecting circuit of FIG. 36 can be used in the third embodiment by rearranging it such that the make contacts of the electromagnetic switches for rightward and leftward shifting are connected in parallel between the (+) and (−) terminals as in FIG. 16 of the first embodiment, and hence said circuit for the third embodiment is not shown.

Figure 40:
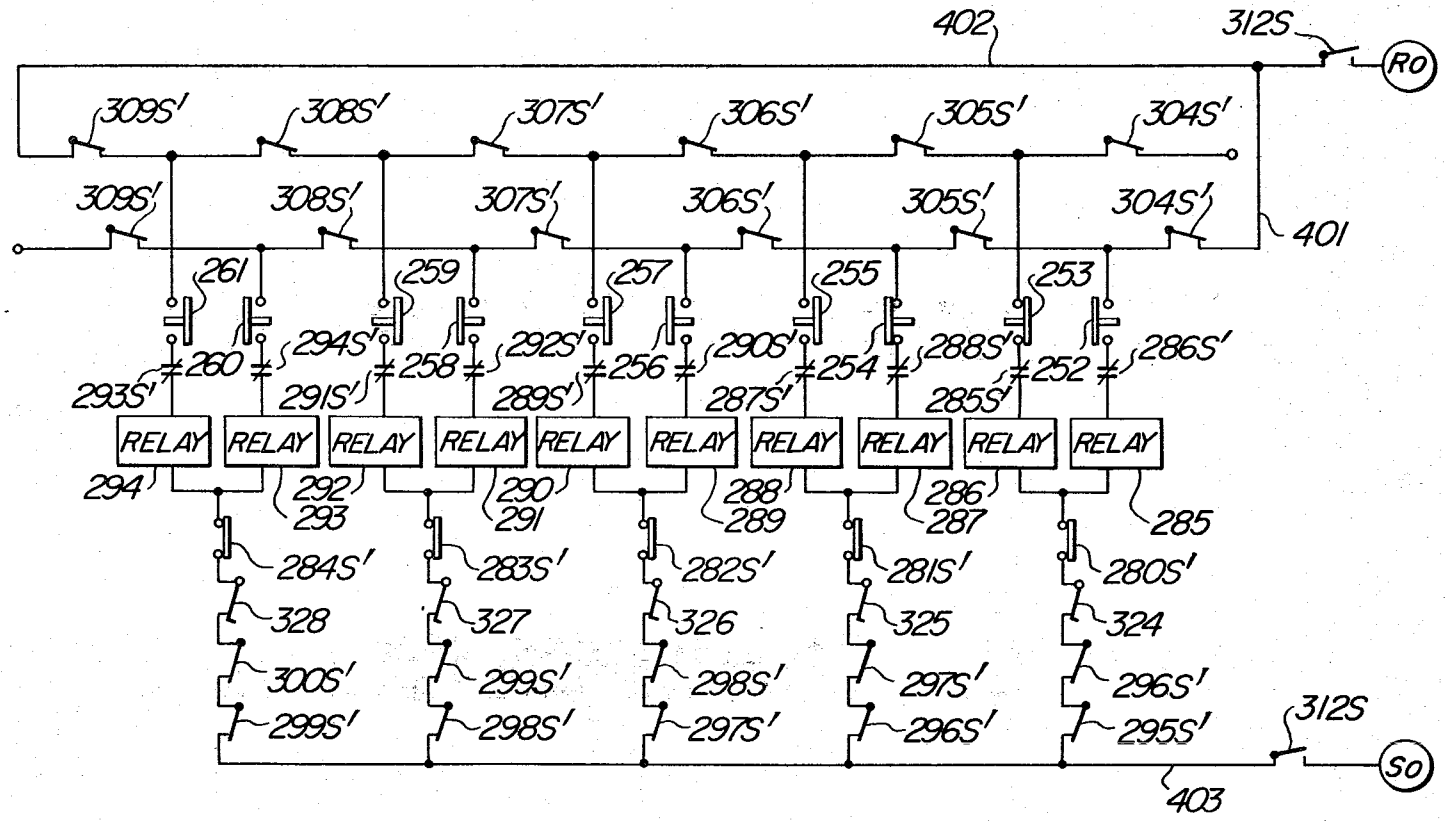
FIG. 40 is a circuit diagram of a shiftable stack selecting circuit in the third embodiment of the invention.

A shiftable stack unit selecting circuit is composed as shown in FIG. 40. As will be clear in comparison with FIG. 32 of the second embodiment, this circuit is connected between conductors 401, 402 and 403 with the same construction as that of FIG. 32, except that the aisle width control devices 265 . . . 272 and their short-circuit switches 320 . . . 323 and contacts 320C . . . 323C are removed from FIG. 32 and the electromagnetic switches 285 . . . 294 for rightward and leftward shifting and their break contacts 285S' . . . 294S' are connected in place of the electromagnetic switch auxiliary relays 401 . . . 410 for rightward and leftward shifting and their break contacts 401S' . . . 410S' respectively.

The positions of the respective limit switches in FIG. 40 are in the case when the aisle B is formed. When the aisle switch 221 is switched on to form the aisle D, the aisle selection signal receiving relay 307 is actuated and its break contact 307S' is opened, whereby the circuits for the rightward shifting of the shiftable stack units 203, 204 and 205 and the circuits for the leftward shifting of the shiftable stack units 206 and 209 are selected, as in the preceding embodiment. However, the shiftable stack unit 203 is already at the end of its rightward stroke, with its limit switch 252 opened, while the shiftable stack units 206 and 207 are already at the ends of their leftward strokes, with the limit switches 295 and 261 opened, and these stack units are not immovable. Consequently, the shiftable stack units 204 and 205 are shifted to the right. First of all, the shiftable stack unit 204 actuates the electromagnetic switch 287 for rightward shifting through the limit switch 254, whereby the motor 241M2 rotates in the reverse direction to shift the shiftable stack unit 204 to the right. The shiftable stack unit 204 continues its movement until the limit switch 254 is opened by the shiftable stack unit 203. When the limit switch 254 is opened, the electromagnetic switch 287 for rightward shifting is restored and the motor 241M2 stops its rotation. By the rightward movement of the shiftable stack unit 204, a space is formed between the shiftable stack units 204 and 205 and the limit switch 256 is restored which has been pushed by the shiftable stack unit 204. Thus, the operating circuit for the electromagnetic switch 289 for rightward shifting is closed and the shiftable stack unit 205 starts to move with a certain time delay from the start of the shiftable stack unit 204. The limit switch 256 is opened by being pushed by the shiftable stack unit 204 to open the operating circuit for the electromagnetic switch 289 for rightward shifting, whereby the rightward shifting of the shiftable stack unit 205 is stopped.

The aisle locking relay 298 in FIG. 30 is actuated at the point when the shiftable stack unit 205 is brought to a halt, so that the operating circuit for the aisle selection signal receiving relay 307 is opened and the start instructing relay 312 in FIG. 31 is restored. In this state, no aisle is selected.

In the third embodiment as well as in the second embodiment, when the aisle has been formed, the shiftable stack unit on both sides of said aisle only are locked and the other shiftable stack units remain in the shiftable state. Therefore, if a space is previously provided which is just sufficient to form two aisles, and the shiftable stack units are segregated into two groups on the right and left sides of the stack unit 205, an aisle can be formed within each group independently of the other group. Namely, all of the shiftable stack units are put together on the right side at first and then the aisle switch of the shiftable stack unit 204 is actuated to form an aisle between the shiftable stack units 204 and 205. Upon formation of the aisle, the aisle switch of the shiftable stack unit 205 is actuated, whereby said shiftable stack unit 205 is brought to a halt. Then, the toggle switch to lock the shiftable stack unit 205 is switched off, whereby said shiftable stack unit 205 can temporarily be used as a stationary stack unit and all of the shiftable stack units can be used in two groups, one consisting of the shiftable stack units 203 and 204 and the right half of the shiftable stack unit 205 and another group consisting of the left half of the shiftable stack unit 205 and the shiftable stack units 206 and 207.

It is, of course, possible to use the shiftable stack units by segregating them into three or more groups, by previously providing a space enough to form two or more aisles.

The aisle width control devices of the second embodiment may be incorporated in the third embodiment described above. In this case, the aisle width control switches and their short-circuit switches of the device are connected between the respective limit switches and the break contacts of the respective electromagnetic switches shown in FIG. 40, whereby the shiftable stack units are stopped automatically when the aisle being formed therebetween has reached a predetermined width.

It will be obviously understood that the aisle width control device may be provided on the movable floor means of the first embodiment.

What is claimed is:

1. In a shiftable storage means including a plurality of movable stacks, supporting means for each of said stacks, including a reversible electric motor and two relay means for each of said stacks for controlling the direction of the motors and stacks, and a plurality of safety switches secured to the sides of each movable stack for cutting off the current to the motors when the stacks move too close to each other; the improvement which comprises: a normally open pair of relay contacts mounted on one of said relay means for completing a bypass circuit around a safety switch on an adjacent stack for permitting both stacks to be moved in unison in a desired direction to open a space between stacks.

2. A storage means as claimed in Claim 1 wherein said normally open contects are closed whenever the relay, on which said contacts are mounted, is activated.

3. A storage means as claimed in claim 1 wherein all the safety switches are each respectively connected in series with an operating winding on said relay means for stopping the motor whenever a stack closes an access aisle and its safety switch is operated by contact with the adjacent stack.

4. A storage means as claimed in claim 1 wherein said bypass circuit includes the winding of said relay means, a pair of normally closed contacts on a second relay that remains unactuated during a shifting operation, said normally open contacts, the closed safety switch adjoining the open aisle, and a source of alternating current power.

5. A storage means as claimed in claim 1 wherein one of said relay means for controlling the direction of the motors applies A.C. power to send the stack in one direction and the other of said relay means for controlling the same motor applies A.C. power to send the stack in the reverse direction.

6. A storage means as claimed in claim 5 wherein one of said normally open relay contacts is mounted on each one of said relay means except the relay means that controls the left hand movable stack to move to the right and the relay means that controls the right hand movable stack to move to the left.

7. In a shiftable storage means including a plurality of movable stacks, supporting means for each of said stacks including a reversible electric motor and two relay means for applying A.C. electrical power to the motors to control their motion and direction, a safety switch secured to each side of each movable stack for cutting off the A.C. power to the motors when the stacks move too close to each other; the improvement which comprises; a normally open pair of relay contacts mounted on each of said relay means except the relay means that controls the left hand movable stack to move to the right and the relay means that controls the right hand movable stack to move to the left; each of said pair of relay contacts connected to a bypass circuit around a safety switch for supplying control power to an adjacent stack for permitting both stacks to be moved in unison in a desired direction to open a space between stacks; said bypass circuit including the winding of said relay means, a pair of normally closed contacts on a second relay that remains unactuated during a shifting operation, the closed safety switch adjoining the open aisle, and a source of A.C. power.

* * * * *

UNITED STATES PATENT AND TRADEMARK OFFICE

CERTIFICATE OF CORRECTION

PATENT NO. : 4,422,816

DATED : December 27, 1983

INVENTOR(S) : Han-Ichiro Naito, et al

It is certified that error appears in the above-identified patent and that said Letters Patent is hereby corrected as shown below:

Front page, under item [30], line 2, change "Jun. 14, 1970" to -- July 14, 1970 -- .

Col. 2, line 15, delete "each".

Col. 3, line 16, change "seleting" to -- selecting -- .

Col. 5, line 7, change "electromagnet" to -- electromagnetic -- .

Col. 5, line 42, change "to" to -- the -- .

Col. 10, line 31, change "dischrage" to -- discharge -- .

Col. 10, line 55, delete "is" and insert -- or -- .

Col. 11, line 68, change "abstacle" to -- obstacle -- .

Col. 12, line 1, change "shown" to -- show -- .

Col. 12, line 27, change "as" to -- As -- .

UNITED STATES PATENT AND TRADEMARK OFFICE

CERTIFICATE OF CORRECTION

PATENT NO. : 4,422,816

DATED : December 27, 1983

INVENTOR(S) : Han-Ichiro Naito, et al

It is certified that error appears in the above-identified patent and that said Letters Patent is hereby corrected as shown below:

Col. 13, line 13, change "shows" to -- show -- .

Col. 15, line 19, before "make" insert -- set of -- .

Col. 16, line 4, change "short-circuiting" to -- short-circuit -- .

Col. 16, line 20, change "404" to -- 404S -- .

Col. 16, line 21, change "404S" to -- 404 -- .

Col. 16, line 47, change "310C"to -- 320C -- .

Col. 18, line 12, delete "of" and insert -- to -- .

Col. 18, line 23, cancel "during" (first occurrence in line).

Col. 20, line 42, change "opened" to -- open -- .

Col. 20, line 66, change "the limit switch 257" to -- make contact 408S -- .

Col. 23, line 17, change "shitable" to -- shiftable -- .

UNITED STATES PATENT AND TRADEMARK OFFICE

CERTIFICATE OF CORRECTION

PATENT NO. : 4,422,816

DATED : December 27, 1983

INVENTOR(S) : Han-Ichiro Naito, et al

It is certified that error appears in the above-identified patent and that said Letters Patent is hereby corrected as shown below:

Col. 23, line 58, change "aisle" to -- aisles -- .

Col. 26, line 49, between "for" and "motor", insert -- a -- .

Col. 30, line 6, (Claim 2, line 2), change "contects" to -- contacts -- .

Signed and Sealed this

*Twelfth* Day of *June 1984*

[SEAL]

*Attest:*

GERALD J. MOSSINGHOFF

*Attesting Officer*

*Commissioner of Patents and Trademarks*